US006064844A

United States Patent [19]

Isobe et al.

[11] Patent Number: 6,064,844

[45] Date of Patent: May 16, 2000

[54] DEVELOPING APPARATUS

[75] Inventors: Hironobu Isobe, Numazu; Kouji Hashimoto, Shizuoka-ken, both of Japan

[73] Assignee: Canon Kabushiki Kaisha, Tokyo, Japan

[21] Appl. No.: 09/382,392

[22] Filed: Aug. 25, 1999

[30] Foreign Application Priority Data

Aug. 31, 1998 [JP] Japan ..... 10-262421

[51] Int. Cl.[7] ..... G03G 21/00; G03G 15/08

[52] U.S. Cl. ..... 399/119; 399/103; 399/262; 399/263

[58] Field of Search ..... 399/103, 106, 399/119, 262, 263

[56] References Cited

U.S. PATENT DOCUMENTS 5,075,728 12/1991 Kobayashi et al. ..... 399/103 X
5,325,163 6/1994 Nishio ..... 399/106
5,826,132 10/1998 Damji et al. ..... 399/119 X

*Primary Examiner*—Susan S. Y. Lee

*Attorney, Agent, or Firm*—Fitzpatrick, Cella, Harper & Scinto

[57] ABSTRACT

A developing apparatus having a developer containing portion including an opening portion for supplying a developer to a developer bearing member, a sheet member for unsealably sealing the opening portion, and a partition wall for partitioning a space of a developer containing portion into a first space and a second space more remote from the developer bearing member than the first space. The partition wall has an angle of 30 degrees or less with respect to a surface on which the sheet member is supported, and has an angle of 40 degrees or more with respect to a horizontal plane when the developing apparatus is attached to a main body of an image forming apparatus. A first carrying and a second carrying member are disposed in the first space and the second space respectively to carry the developer to the opening portion. Before the sheet member is unsealed, the second carrying member is stopped so that a tip end portion of the second carrying member in a rotation radius direction thereof comes close to a tip end portion of the partition wall, and the first carrying member is stopped so that a rotation phase deviates from a stop position of the second carrying member on an upstream side of the rotating direction by an angle of 75 degrees and 105 degrees.

16 Claims, 22 Drawing Sheets

FIG. 19A
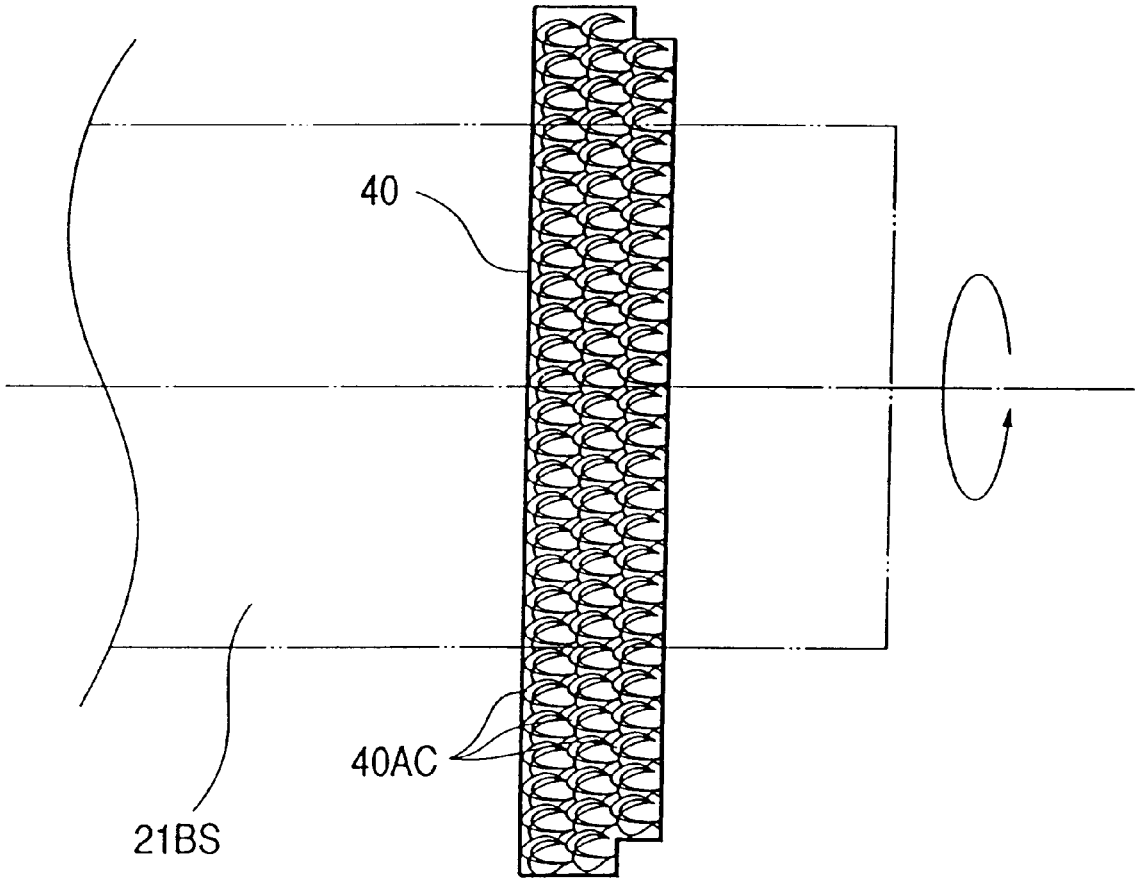
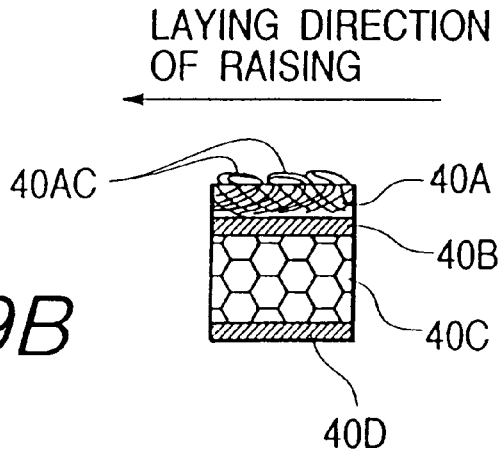
FIG. 19B

DEVELOPING APPARATUS

BACKGROUND OF THE INVENTION

1. Field of the Invention

The present invention relates to a developing apparatus which can be used in an image forming apparatus.

Here, the image forming apparatus uses an electrophotographic image forming process to form an image on a recording material, and examples thereof include an electrophotographic copying machine, an electrophotographic printer (LED printer, laser beam printer, and the like), an electrophotographic facsimile machine, an electrophotographic word processor, and the like.

2. Related Background Art

In an electrophotographic image forming apparatus, for example, a printer, selective exposure is performed to an image bearing member (photosensitive drum) uniformly charged by a charging device to form a latent image, the latent image is visualized with a developer (toner) by a developing device, and the image by the developer is transferred to a recording material to perform image recording. Subsequently, after the transfer, the developer remaining on the image bearing member is removed with a cleaning blade, the developer is stored in a cleaner container, and the next development is performed by the image bearing member with a cleaned surface.

In recent years, an apparatus has been turned to practical use in which the image bearing member, charging device, developing device, cleaning portion, waste toner box, and the like are integrally structured into a cartridge, and a user mounts the cartridge onto a main body of the apparatus (an apparatus main body), so that component replacement of the developer image bearing member is realized, and maintenance is facilitated.

Furthermore, when a life of the image bearing member is extended and the number of printable sheets is increased, the developing device whose supplying ability is limited is used as an independent unit. The apparatus is divided into the developing unit and a drum unit in which the image bearing member as image forming process means, charging device and cleaning portion are integral. In the same manner as a process cartridge, the mounting onto the apparatus main body and the maintenance are facilitated. Additionally, the apparatus is increasingly used in accordance with the life of each main component. Waste toner generated in the drum unit by cleaning is stored in a cleaning container which has a capacity to sufficiently contain the toner during the image bearing member's life, and removed at the time of drum unit replacement.

In recent years, a color electrophotographic image forming apparatus which can form color images is increasingly demanded. For example, a constitution is known in which four-color developing apparatuses are all arranged in a rotary (e.g., U.S. Pat. No. 4,707,108, U.S. Pat. No. 5,040,031, and the like).

The constitution is very effective for forming the color images.

On the other hand, a color electrophotographic image forming apparatus for application to a future network needs to handle a large amount of high-speed outputs, whether a color document can be outputted or not. Moreover, it is desirable to reduce a cost per page like in a monochromatic electrophotographic image forming apparatus.

To meet the demand, life lengthening of consumable for use in the apparatus (e.g., the developing unit and the drum unit as the image bearing unit, the process cartridge in which the developing unit and the image bearing unit are integral, and the like) needs to be intended.

For this purpose, for example, the developing unit needs to be provided with a large-capacity developer containing portion which contains a large amount of developer.

Moreover, in order to handle the high-speed output, developer supply needs to be increased. For example, an opening (opening portion) formed in the developer containing portion of the developing unit has to be enlarged in such a manner that a stable developer supply can be performed.

Then, a width of a sheet-shaped unsealable seal member to seal the opening is also increased.

However, when the developer containing portion is enlarged, a weight of the developer is proportionally enlarged. Then, a surface pressure of the developer to the unsealable seal member to seal the opening of the developer containing portion is also enlarged.

In this state, for example, when the developing unit is dropped, a large powder pressure is applied to the unsealable seal member, a part of the unsealable seal member is broken, and the developer may leak.

When the developer leaks to the outside of the developing unit, during operation a user's body is probably made dirty. Moreover, when the developing unit itself is very dirty, it must be replaced with a new one.

SUMMARY OF THE INVENTION

The present invention is a further development of the above-described conventional art, and a main object thereof is to provide a developing apparatus in which a sheet member in an opening of a developer containing portion is prevented from being broken by impact or vibration during flow of materials.

BRIEF DESCRIPTION OF THE DRAWINGS

FIGS. 19A and 19B are explanatory views of a toner seal member of the embodiment.

DETAILED DESCRIPTION OF THE PREFERRED EMBODIMENTS

A color electrophotographic image forming apparatus to which a developing apparatus of the present invention can be attached will be described below with reference to the drawings.

[Description of Entire Image Forming Apparatus]

First, an entire constitution of the color electrophotographic image forming apparatus will generally be described with reference to FIG. 1.

Figure 1:
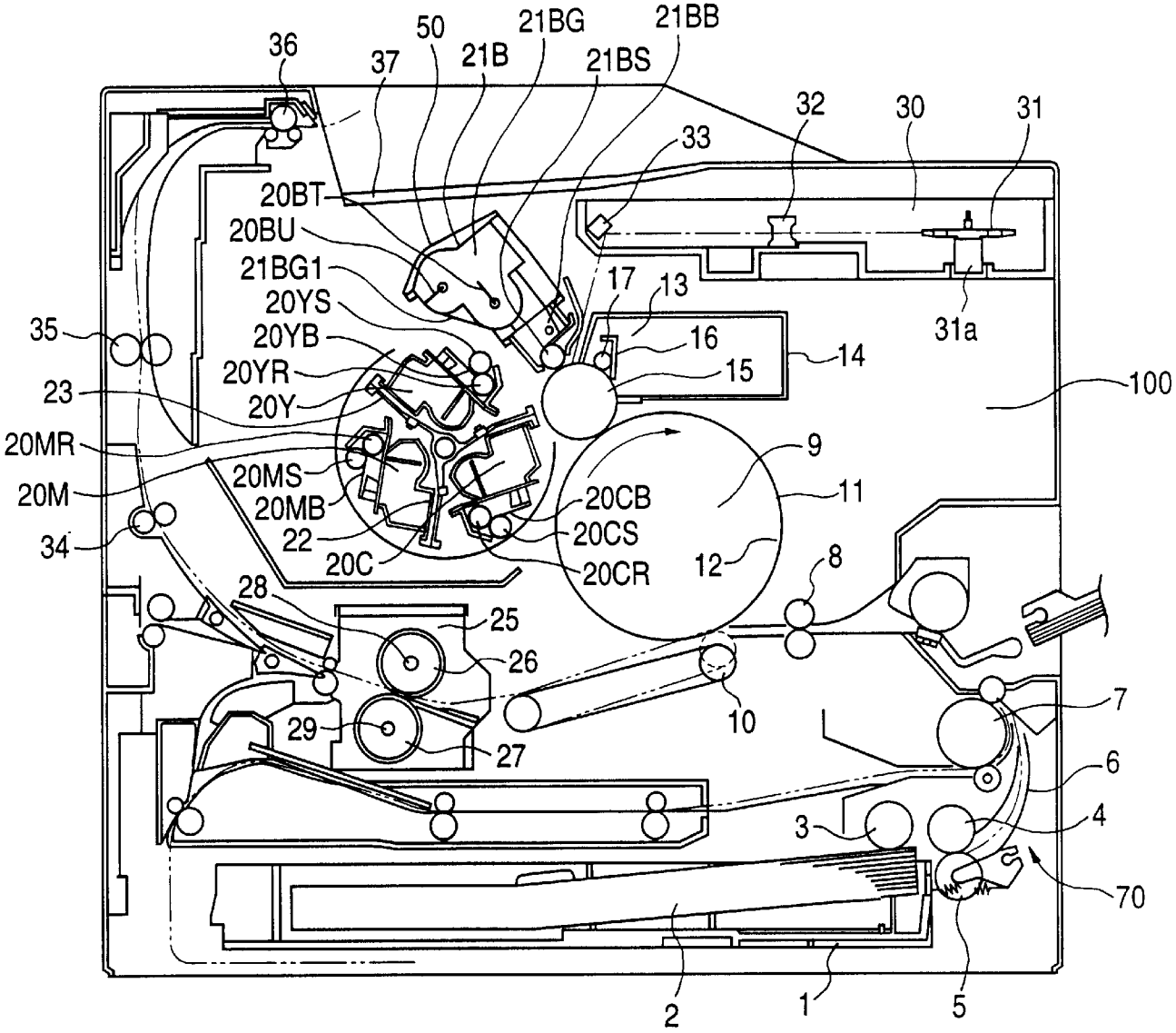
FIG. 1 is a sectional view of a color laser printer of an embodiment.

FIG. 1 is an explanatory view of the entire constitution of a laser beam printer which is one embodiment of a color toner image forming apparatus.

An image forming portion of the color laser beam printer is provided with an image bearing member (photosensitive drum (cylindrical member)) 15 as an electrophotographic photosensitive member which rotates at a constant speed, a fixed type black developing unit 21B, and three rotatable color developing units (yellow developing unit 20Y, magenta developing unit 20M, cyan developing unit 20C).

Below the image forming portion, an intermediate transfer member 9 is disposed which holds a developed and multi-transferred color toner image and further transfers the image to a recording material 2 supplied from a supplying portion.

Subsequently, the recording material 2 with the color toner image transferred thereto is conveyed to a fixing portion 25 to fix the color toner image to the recording material 2, and discharged to a discharge portion 37 on an upper surface of the apparatus by discharge rollers 34, 35, 36. Here, examples of the recording material include sheets, or OHP sheets, and the like.

Additionally, the rotatable color developing units 20Y, 20M, 20C and the fixed type black developing unit 21B are individually detachably attachable relative to a printer main body (image forming apparatus main body) 100. Moreover, a sheet supply roller 3, a feeding roller 4, a retard roller 5 to prevent double feeding, a feeding guide 6, a conveying roller 7, a registration roller 8 and the discharge rollers 34, 35, 36 constitute conveying means 70 as described later.

Constitutions of portions of the above-described image forming apparatus will serially be described hereinafter in detail.

[Image Bearing Unit]

In a drum unit 13, the image bearing member 15, a cleaning apparatus provided with a cleaning member (cleaning means) 16, a charging apparatus provided with a charging member (charging means) 17, and a cleaner container 14 of a cleaning apparatus serving also as a holder of the image bearing member 15 are integrally constituted. Additionally, the drum unit 13 is inserted in a horizontal direction to a unit containing portion from an attachment port (not shown) disposed in the printer main body 100, and attachably/detachably supported relative to an attaching guide (not shown) as attaching means disposed in the unit containing portion. Therefore, the drum unit 13 can easily be detached from the printer main body 100 by a user, and is replaced when the image bearing member 15 ends its life.

In the image bearing member 15 of the embodiment, an organic photoconductive layer is applied to an outer side of an aluminum cylinder having a diameter of about 62 mm. Additionally, the member is rotatably supported by the cleaning apparatus container 14 which also serves as the holder of the image bearing member 15.

Along a peripheral surface of the image bearing member 15, the cleaner blade 16 as the cleaning member, and the primary charging means 17 as the charging member are arranged.

Moreover, in one rear end of the image bearing member 15, a drive motor (not shown) is disposed. A drive force is transmitted to rotate the image bearing member 15 counterclockwise as seen in the drawing in accordance with an image forming operation.

Here, the cleaner blade 16 abuts against the image bearing member 15 to remove toner remaining on a surface of the image bearing member 15 after the toner image is transferred.

[Charging Means]

The charging means 17 uses a contact charging method. Additionally, a charging roller as the charging member, for example, a conductive roller abuts against the image bearing member 15.

By applying a voltage to the charging roller, the surface of the image bearing member 15 is uniformly charged.

[Exposure Means]

Exposure to the image bearing member 15 is performed from a laser scanner portion 30. Specifically, when an image signal is transmitted to a laser diode (not shown), the laser diode radiates light 18 corresponding to the image signal to a polygon mirror 31.

The polygon mirror 31 is rotated at high speeds by a scanner motor 31*a*, and the surface of the image bearing member 15 rotating at a constant speed is selectively exposed to the light 18 reflected by the polygon mirror 31 via an image forming lens 32 and a reflecting mirror 33. As a result, an electrostatic latent image is formed on the image bearing member 15 in accordance with image information.

[Developing Mechanism]

To visualize the electrostatic latent image, a developing mechanism of the embodiment is provided with three rotatable developing units 20Y, 20M, 20C and one black developing unit 21B which realize color development of yellow, magenta, cyan and black.

Additionally, during formation of a color image, every time the intermediate transfer member 9 rotates once, a developing rotary 23 rotates, and a developing process is performed in sequence from the yellow developing unit 20Y, the magenta developing unit 20M, the cyan developing unit 20C, finally the black developing unit 21B.

[Color Developing Unit]

Each of the three rotatable developing units 20Y, 20M, 20C contains a toner corresponding to about 7000 images (A4 size paper, printing ratio of 4%). Additionally, the units are detachably held by the developing rotary 23 as holding means which rotates centering on a rotary rotating shaft (hereinafter referred to as the shaft) 22. The developing rotary 23 is provided with the attaching guide (not shown) as the attaching means to detachably attach the rotatable developing units 20Y, 20M, 20C, respectively. During the image formation, the developing units 20Y, 20M, 20C held by the developing rotary 23 rotate/move centering on the shaft 22. Subsequently, among the developing units 20Y, 20M, 20C, the predetermined developing unit 20Y, 20M, or 20C stops in a position opposite to the image bearing member 15.

During formation of the color toner image, every time the intermediate transfer member 9 rotates once, the developing rotary 23 rotates, and the developing process is performed in sequence from the yellow developing unit 20Y, the magenta developing unit 20M, the cyan developing unit 20C, then the black developing unit 21B.

Figure 2:
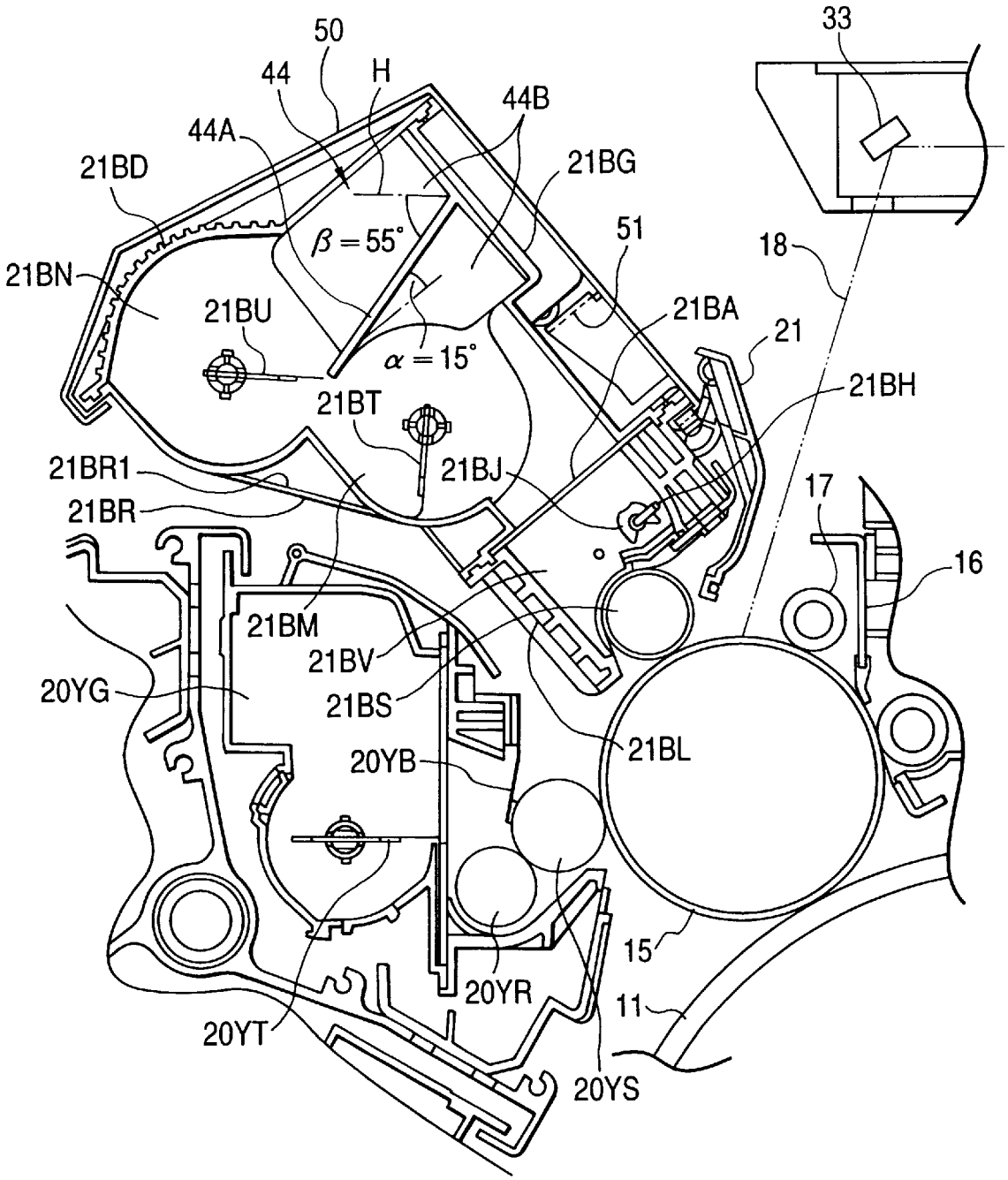
FIG. 2 is a sectional view showing a periphery of a black developing unit of the embodiment.

FIG. 2 shows a state in which among the color developing units, the rotatable yellow developing unit 20Y is positioned opposite to the image bearing member 15 and stands still. The rotatable developing unit 20Y feeds yellow toner (yellow developer) in the container to an applying roller 20YR by a feeding member 20YT.

By the applying roller 20YR rotating clockwise as seen in the drawing and a developing blade 20YB in pressure contact with an outer periphery of a developing roller (cylindrical member) 20YS as developing means, a thin layer of yellow toner is applied to the outer periphery of the developing roller 20YS which rotates clockwise as seen in the drawing, and an electric charge is applied to the yellow toner (frictional charging).

Subsequently, by applying a developing bias to the developing roller 20YS which is opposed to the image bearing member 15 with the latent image formed thereon, a yellow toner image is formed on the image bearing member 15 in accordance with the latent image. For the magenta developing unit 20M, and the cyan developing unit 20C, the color toner developing is performed in a mechanism similar to the above-described mechanism.

Here, the yellow developing unit 20Y has the applying roller 20YR, the developing blade YB, the developing roller 20YS, and a yellow toner containing portion 20YG which contains the yellow toner. In the same manner, the magenta developing unit 20M has an applying roller 20MR, a developing blade 20MB, a developing roller 20MS, and a magenta toner containing portion MG which contains magenta toner. Moreover, the cyan developing unit 20C has an applying roller 20CR, a developing blade 20CB, a developing roller 20CS, and a cyan toner containing portion CG which contains cyan toner (refer to FIG. 1).

When the developing unit 20Y, 20M, or 20C is rotated/moved to the developing position, the developing roller 20YS, 20MS, or 20CS in the rotatable developing unit 20Y, 20M, or 20C is connected to a high-voltage power supply (not shown) for each color development disposed in the printer main body 100, and a drive portion (not shown). Subsequently, a voltage is serially and selectively applied to the color developing units 20Y, 20M, 20C, and a drive is also connected thereto.

[Intermediate Transfer Member]

During the color toner image forming operation, to the intermediate transfer member 9, toner images on the image bearing member 15 visualized by the developing units 20Y, 20M, 20C are multi-transferred four times (four-color images of Y, M, C and B). For this purpose, the member 9 rotates clockwise as seen in the drawing in synchronization with an outer peripheral speed of the image bearing member 15 (refer to FIG. 1).

Moreover, the intermediate transfer member 9 subjected to multiple transfers holds and conveys the recording material 2 with a transfer roller 10 to which the voltage is applied, so that the color toner images on the intermediate transfer member 9 are simultaneously multi-transferred to the recording material 2.

The intermediate transfer member 9 of the embodiment is constituted by coating an outer periphery of an aluminum cylinder 12 with a diameter of 186 mm with an elastic layer 11 of medium resistance sponge, medium resistance rubber, or the like. The intermediate transfer member 9 is driven and rotated by a gear (not shown) which is rotatably supported and integrally fixed by the printer main body 100.

[Cleaning Means]

For the cleaning means, after the toner images visualized on the image bearing member 15 by the developing rollers (developing means) 20YS, 20MS, 20CS, 21BS of the developing units 20Y, 20M, 20C, 21B are transferred to the intermediate transfer member 9, the toner remaining on the image bearing member 15 is cleaned. Thereafter, cleaned/removed toner is stored in the cleaner container 14. The cleaner container 14 can contain the removed toner corresponding to and more than the life of the image bearing member 15 (about 50,000 images).

Therefore, when the image bearing member 15 ends its life, the cleaner container 14 is also replaced together with the member. In the embodiment, the cleaning blade 16 is used as the cleaning member. The cleaning blade 16 abuts against the surface of the image bearing member 15.

[Sheet Supply Portion]

A sheet supply portion supplies the recording material 2 to the image forming portion, and is mainly constituted of, as shown in FIG. 1, a supply sheet cassette 1 which contains a plurality of recording materials 2, the supply roller 3, the feeding roller 4, the retard roller 5 to prevent the double feeding, the feeding guide 6, the conveying roller 7, and the registration roller 8.

During the image formation, the supply roller 3 is driven/rotated in accordance with the image forming operation, and the recording material 2 in the supply cassette 1 is separately fed sheet by sheet, guided by the feeding guide plate 6, and fed to the registration roller 8 via the conveying roller 7.

During the image forming operation, the registration roller 8 performs a non-rotating operation in which the recording material 2 stands still on standby, and a rotating operation in which the recording material 2 is conveyed toward the intermediate transfer member 9 in a predetermined sequence, and performs positioning of the toner image and the recording material 2 during a transfer process as the next process.

[Transfer Portion]

As shown in FIG. 1, a transfer portion is provided with a transfer belt 10 which can swing as a transfer member. The transfer belt 10 is a belt formed of a rubber having a high-resistance surface layer (surface resistance is in the range of $10^9$ to $10^{13}$ Ω), and can swing vertically in the drawing and additionally rotate.

While the toner image is formed on the intermediate transfer member 9, that is, while the intermediate transfer member 9 rotates a plurality of times, not to disturb the image, the transfer belt 10 is positioned below and apart from the intermediate transfer member 9 as shown by a solid line in the drawing.

Specifically, while four-color toner images are formed on the intermediate transfer member 9, that is, while the intermediate transfer member 9 rotates a plurality of times, not to disturb the toner image, the transfer belt 10 is retracted downward from the intermediate transfer member 9.

After the four-color toner images have been formed on the intermediate transfer member 9, in accordance with a timing at which the color toner images are transferred to the recording material 2, the transfer belt 10 is pressed against the intermediate transfer member 9 with a predetermined pressure by a cam member (not shown) via the recording material 2 in an upper position shown by a broken line in the drawing. In this case, since a bias is simultaneously applied to the transfer belt 10, the toner image on the intermediate transfer member 9 is transferred to the recording material 2.

Here, the intermediate transfer member 9 and the transfer belt 10 are individually driven. Therefore, the recording material 2 held between these components is subjected to the transfer process, and is simultaneously conveyed toward the left as seen in the drawing at a predetermined speed and conveyed toward a heating/fixing device as the next process.

[Fixing Portion]

The toner images formed on the image bearing member 15 by the developing rollers (developing means) 20YS, 20MS, 20CS, 21BS of the developing units 20Y, 20M, 20C, 21B are transferred onto the recording material 2 via the intermediate transfer member 9. Subsequently, the heating/fixing device 25 fixes the toner images transferred onto the recording material 2 using heat.

As shown in FIG. 1, the heating/fixing device 25 is provided with a fixing roller 26 for applying heat to the recording material 2 and a pressure roller 27 for placing the recording material 2 in pressure contact with the fixing roller 26, and the rollers 26, 27 are hollow rollers. The rollers have heaters 28, 29 therein, respectively. Additionally, the device is rotated/driven to simultaneously convey the recording material 2.

Specifically, the recording material 2 holding the toner images is conveyed by the fixing roller 26 and the pressure roller 27. Additionally, by applying heat and pressure, the toner images are fixed to the recording material 2.

[Black Developing Unit]

The black developing unit 21B of the embodiment is removably fixed and attached to the printer main body 100. Namely, the black developing unit 21B is inserted in the horizontal direction (rotating axial line direction of the image bearing member) to the unit containing portion from the attachment port (not shown) disposed in the printer main body 100, and detachably supported relative to the attaching guide (not shown) as the attaching means disposed in the unit containing portion. Here, the black developing unit 21B has a toner containing portion 21BG as a developer containing portion which contains black toner, and the developing roller 21BS (refer to FIG. 2).

As shown in FIG. 2, in the black developing unit 21B, the toner in the container is fed into a first agitating portion 21BM by a second feeding member 21BU of a second agitating portion 21BN, and the toner is fed toward the developing roller 21BS by a first feeding member 21BT via an opening 21BA. Subsequently, by an applying blade (applying means) 21BB in pressure contact with an outer periphery of the developing roller 21BS, the toner is applied to the outer peripheral surface of the developing roller 21BS, and additionally an electric charge is applied to the toner (frictional charging) (refer to FIGS. 2 and 3).

Subsequently, by applying a developing bias to the developing roller 21BS, reversal developing (jumping developing) is performed in accordance with the electrostatic latent image of the image bearing member 15, and the toner image is formed on the surface of the image bearing member 15 by the black toner.

Figure 21:
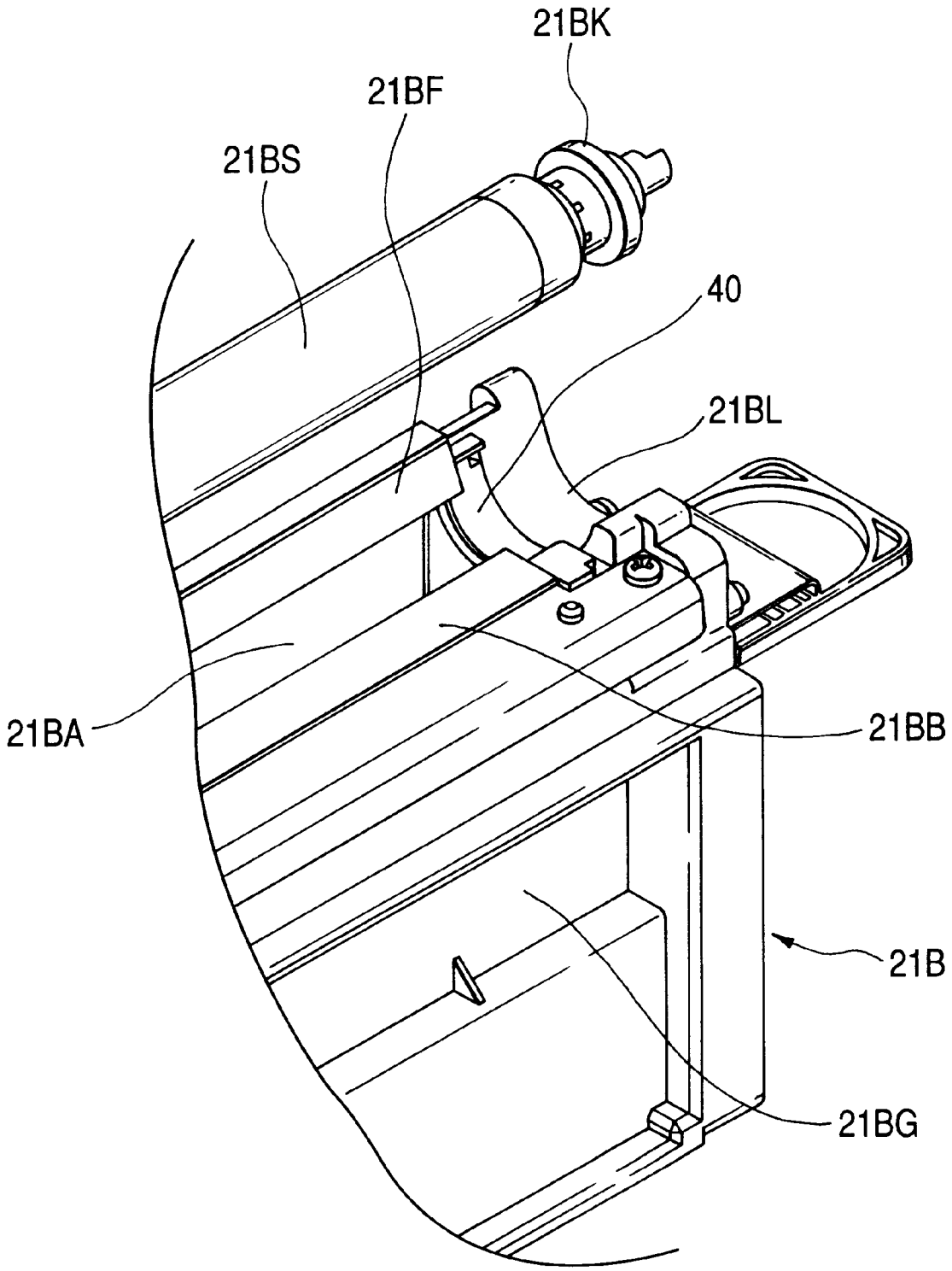
FIG. 21 is an enlarged perspective view of the black developing unit of the embodiment.

As shown in FIG. 21, spacer rollers 21BK are coaxially disposed on opposite end portions of the developing roller 21BS of the black developing unit 21B, and an outer diameter of the spacer roller 21BK is slightly larger than an outer diameter of the developing roller 21BS.

Since the spacer rollers 21BK abut against the outer peripheral surface of the image bearing member 15, the developing roller 21BS secures a slight gap (about 300 μm) from the image bearing member 15.

Subsequently, the toner image by the black toner is formed in accordance with the electrostatic latent image of the image bearing member 15. The constitution in which a slight gap is formed between the image bearing member 15 and the developing roller 21BS is also applied to the other colors.

Here, in consideration of toner consumption, a toner capacity of the black developing unit 21B is set to about twice or more the toner capacity of the rotatable developing unit 20Y, 20M, or 20C, and the toner corresponding to 17,000 images (A4 size, printing ratio of 4%) is contained.

Moreover, as shown in FIG. 1, the black developing unit 21B is installed between the laser scanner portion 30 as the exposure apparatus and the rotatable developing units 20Y, 20M, 20C.

The black developing unit 21B is disposed in this manner. Therefore, even if during the rotation of the rotatable developing unit 20Y, 20M, or 20C, the toner leaks, the toner is prevented from being scattered to optical components such as the laser scanner portion 30.

This prevents the toner from adhering to the polygon mirror 31, the image forming lens 32, the reflecting mirror 33, and the like and from obstructing the formation of the latent image, so that clear output images can be obtained.

[Adhesion Preventive Measure of Floating Toner to Bottom of Toner Containing Portion]

As shown in FIGS. 1 and 2, when the black developing unit 21B is attached to the main body 100 of the printer (the printer main body 100), a bottom 21BGl of the toner containing portion 21BG is opposed to the developing rotary 23. Therefore, there are cases where the color toner scattered from the developing unit 20M, 20Y, or 20C held by the developing rotary 23 and floating in the printer main body 100 adheres to the bottom 21BG1 of the black developing unit 21B.

Figure 4:
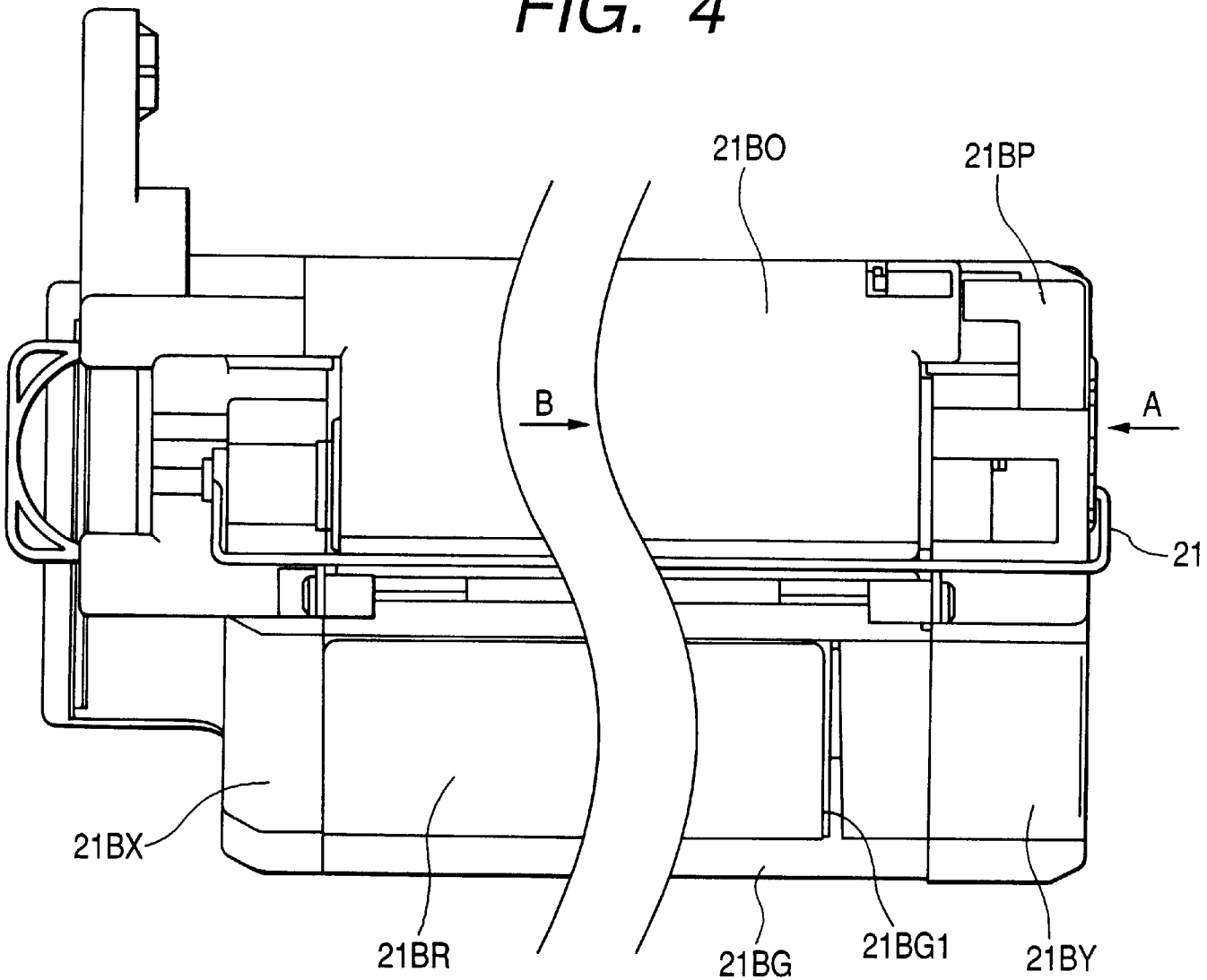
FIG. 4 is a front view of the black developing unit of the embodiment.

To solve the problem, in the embodiment, as shown in FIGS. 2 and 4, a low-resistance cover sheet 21BR which is a low-resistance member is bonded to a bottom surface of the bottom 21BG1 of the toner containing portion 21BG. In the embodiment, the cover sheet 21BR is constituted of an ultra-high-molecular polyethylene sheet material having a surface resistance of $10^6$ Ω or less (specifically, a surface resistivity of $10^{13}$ Ω/sq. or less).

Since the cover sheet 21BR has a low resistance, its surface fails to be remarkably charged. Moreover, since the sheet is constituted of the sheet material having a low friction coefficient such as the ultra-high-molecular polyethylene sheet material, it is superior in a surface smoothing property. These two properties prevent the adhesion of the color toner floating in the printer main body 100.

Since the adhesion of the color toner to the bottom 21BGl of the toner containing portion 21BG can thus be prevented, the black developing unit 21B superior in usability can be realized.

Moreover, in the cover sheet 21BR, as not shown in the drawing, a hole is made in at least one place. In this manner at least one hole is formed in a desired position of the cover sheet 21BR. Therefore, when the cover sheet 21BR is bonded to the bottom 21BG1 of the toner containing portion 21BG, air can be removed from a housing space of the cover sheet 21BR and the toner containing portion 21BG, and during the bonding, wrinkles, and the like can be prevented from being generated in the cover sheet 21BR. Moreover, the air of the housing space of the cover sheet 21BR and the toner containing portion 21BG can be prevented from being expanded by temperature rise, and the cover sheet 21BR can be prevented from swelling.

[Housing Constitution of Black Developing Unit]

Figure 23:
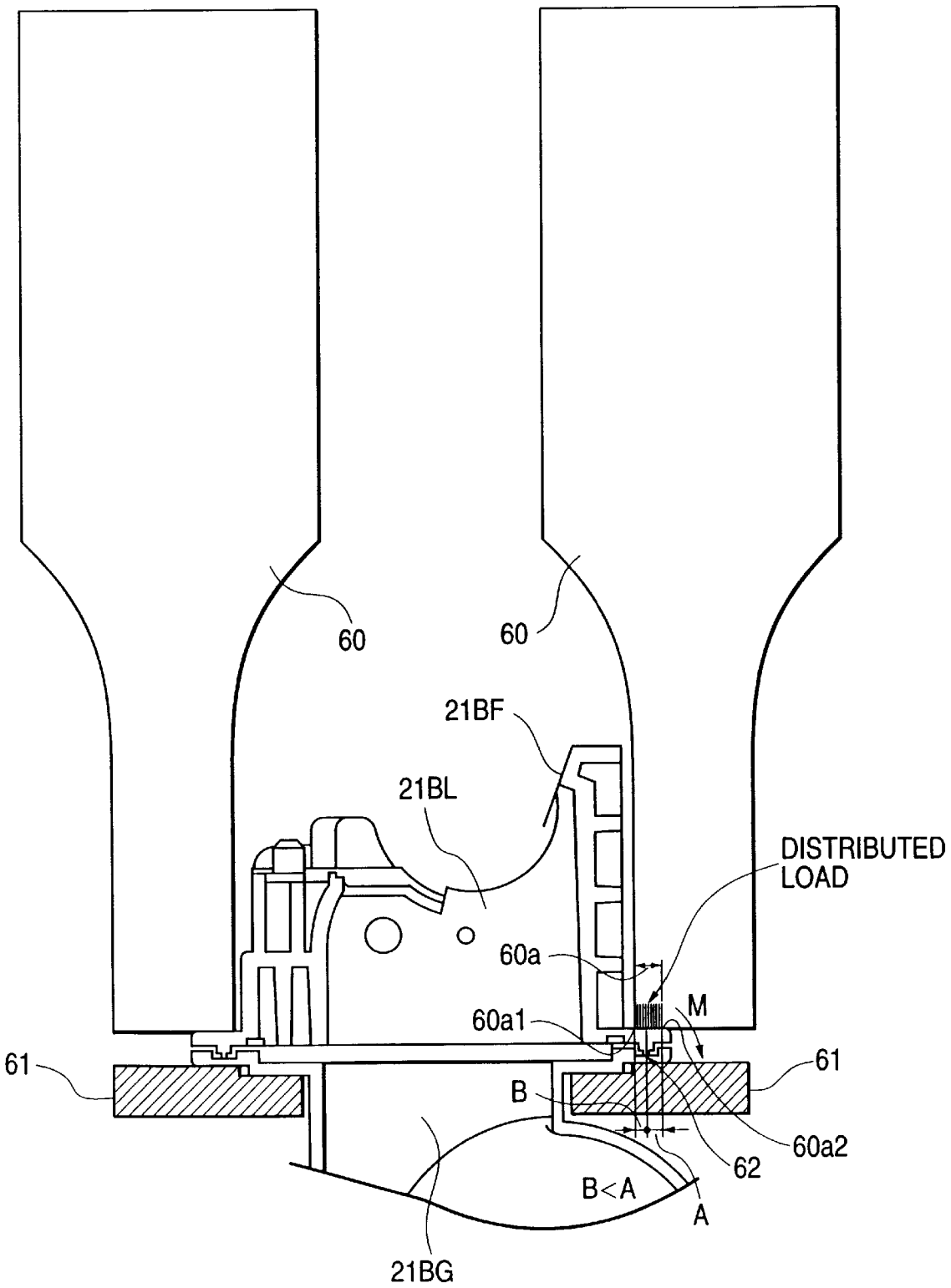
FIG. 23 is a sectional view showing bonding of the black developing unit of the embodiment.

In the black developing unit 21B, as shown in FIG. 23, the toner containing portion 21BG and a developing portion frame 21BL are integrally bonded in an ultrasonic joining method.

A protrusion 62 is formed on a part of the developing portion frame 21BL, and the protrusion 62 abuts against a bottom surface 63*a* of a concave portion 63 formed in a part of the housing of the toner containing portion 21BG.

In this state, when the part of the housing of the toner containing portion 21BG is held by a bearer 61, and the part of the developing portion frame 21BL is pressurized/vibrated by a hone 60, the protrusion 62 is molten in the concave portion 63, and the toner containing portion 21BG and the developing portion frame 21BL are joined.

Figure 22:
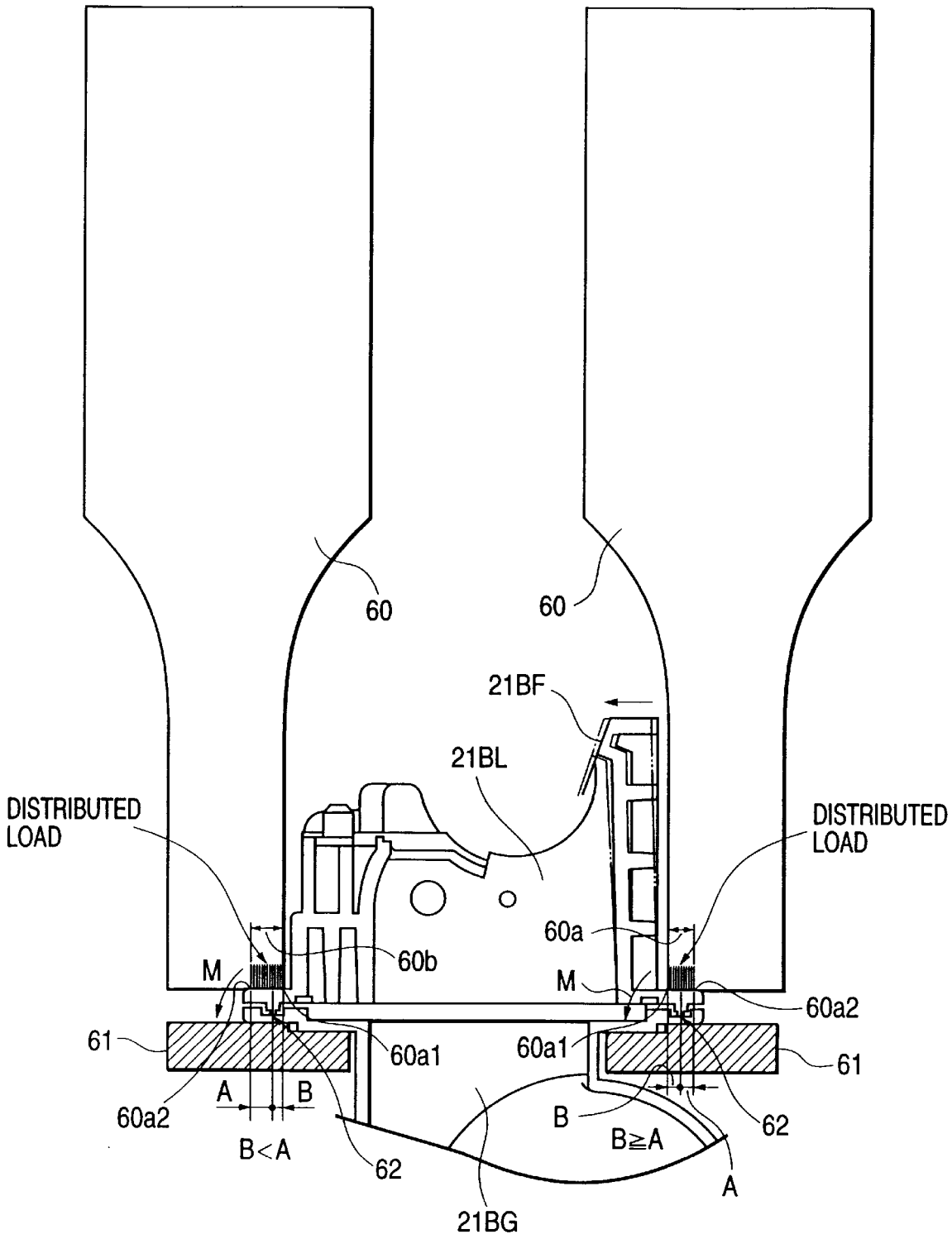
FIG. 22 is a sectional view showing bonding of a conventional black developing unit.

Here, a conventional ultrasonic joining method of the toner containing portion 21BG and the developing portion frame 21BL will be described with reference to FIG. 22.

For the joining of the toner containing portion 21BG and the developing portion frame 21BL, adjustment is made on the side of a blow-off preventing sheet 21BF disposed on the developing portion frame 21BL in such a manner that a relation of a distance B between an inner end 60*a*1 of a bonded area 60*a* in which the hone 60 closely abuts on the developing portion frame 21BL and the protrusion 62 of the developing portion frame 21BL and a distance A between an outer end 60*a*2 of the bonded area 60*a* in which the hone 60 closely abuts on the developing portion frame 21BL and the protrusion 62 of the developing portion frame 21BL satisfies B≧A. Additionally, adjustment is made on an opposite side of the blow-off preventing sheet 21BF of the developing portion frame 21BL in such a manner that a relation of a distance B between an inner end 60*b*1 of a bonded area 60*b* in which the hone 60 closely abuts on the developing portion frame 21BL and the protrusion 62 of the developing portion frame 21BL and a distance A between an outer end 61*b*2 of the bonded area 60*b* in which the hone 60 closely abuts on the developing portion frame 21BL and the protrusion 62 of the developing portion frame 21BL satisfies B<A. In this state, the toner containing portion 21BG and the developing portion frame 21BL are ultrasonic-joined.

In the ultrasonic joining method, however, in the joined areas 60*a* and 60*b* of the developing portion frame 21BL, moment M of the distance B by a pressurizing force (distributed load) of the hone 60 is larger than moment (not shown) of the distance A. Therefore, the housing of the developing portion frame 21BL is deformed toward an inside of an opening shown by an arrow A. As a result, the blow-off preventing sheet (blow-off preventing means) 21BF strongly abuts against the developing roller 21BS (not shown), and a part of the black toner applied to the d roller 21BS (not shown), and a part of the black toner applied to the developing roller 21BS is scraped off, which causes the black toner to float, or generates image unevenness in the strongly abutted portion.

To solve the problem, in the embodiment, when the toner containing portion 21BG and the developing portion frame 21BL are joined, as shown in FIG. 23, adjustment is made in such a manner that the relation of the distance B between the inner end 60*a*1 of the bonded area 60*a* in which the hone 60 closely abuts on the developing portion frame 21BL and the protrusion 62 and the distance A between the outer end 60*a*2 of the bonded area 60*a* in which the hone 60 closely abuts on the developing portion frame 21BL and the protrusion 62 satisfies B<A.

By adjusting the joining as described above, warp of the developing portion frame 21BL can be reduced. Specifically, in the ultrasonic bonding method of the embodiment, since moment M of the distance A by the pressurizing force (distributed load) of the hone 60 in the bonded area 60*a* of the developing portion frame 21BL is larger than the moment (not shown) of the distance B, deforming of the housing of the developing portion frame 21BL toward the inside of the opening shown by an arrow A in FIG. 23 can be straightened. As a result, the warp of the blow-off preventing sheet 21BF bonded to the developing portion frame 21BL is minimized, and the blow-off preventing sheet 21BF can stably be placed in contact with the developing roller 21BS.

Therefore, the stable application of the black toner to the developing roller 21BS is realized, the floating or flying of the black toner is prevented from being caused by scraping off a part of the black toner applied to the developing roller 21BS by the blow-off preventing sheet 21BF, or the generation of image unevenness can be suppressed in the portion against which the blow-off preventing sheet 21BF strongly abuts.

The above-described joining method can preferably be applied also to the yellow developing unit 20Y, the magenta developing unit 20M, and the cyan developing unit 20C.

[Support Structure of Agitating Member of Developing Portion]

Figure 3:
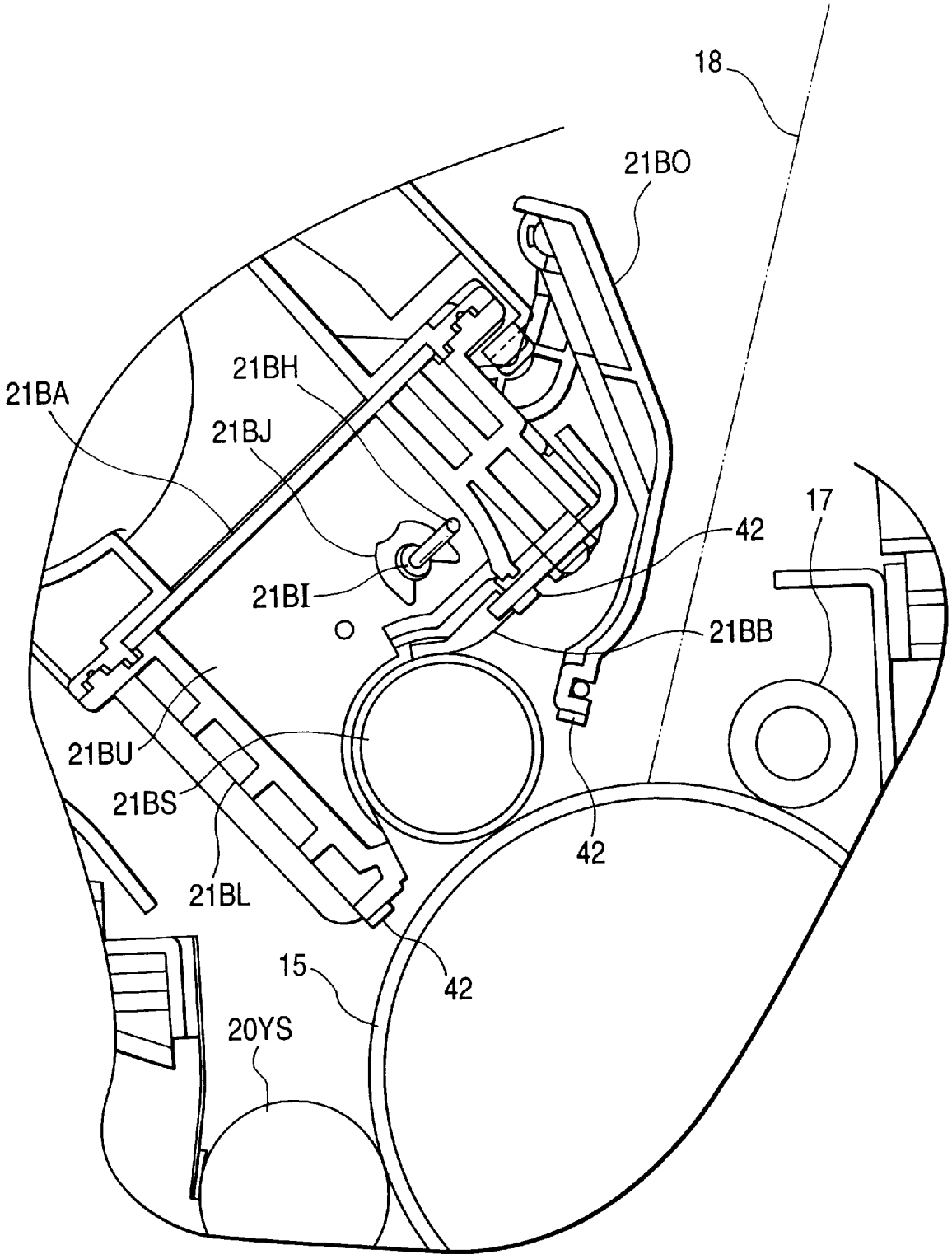
FIG. 3 is an enlarged sectional view of the black developing unit of the embodiment.
Figure 5:
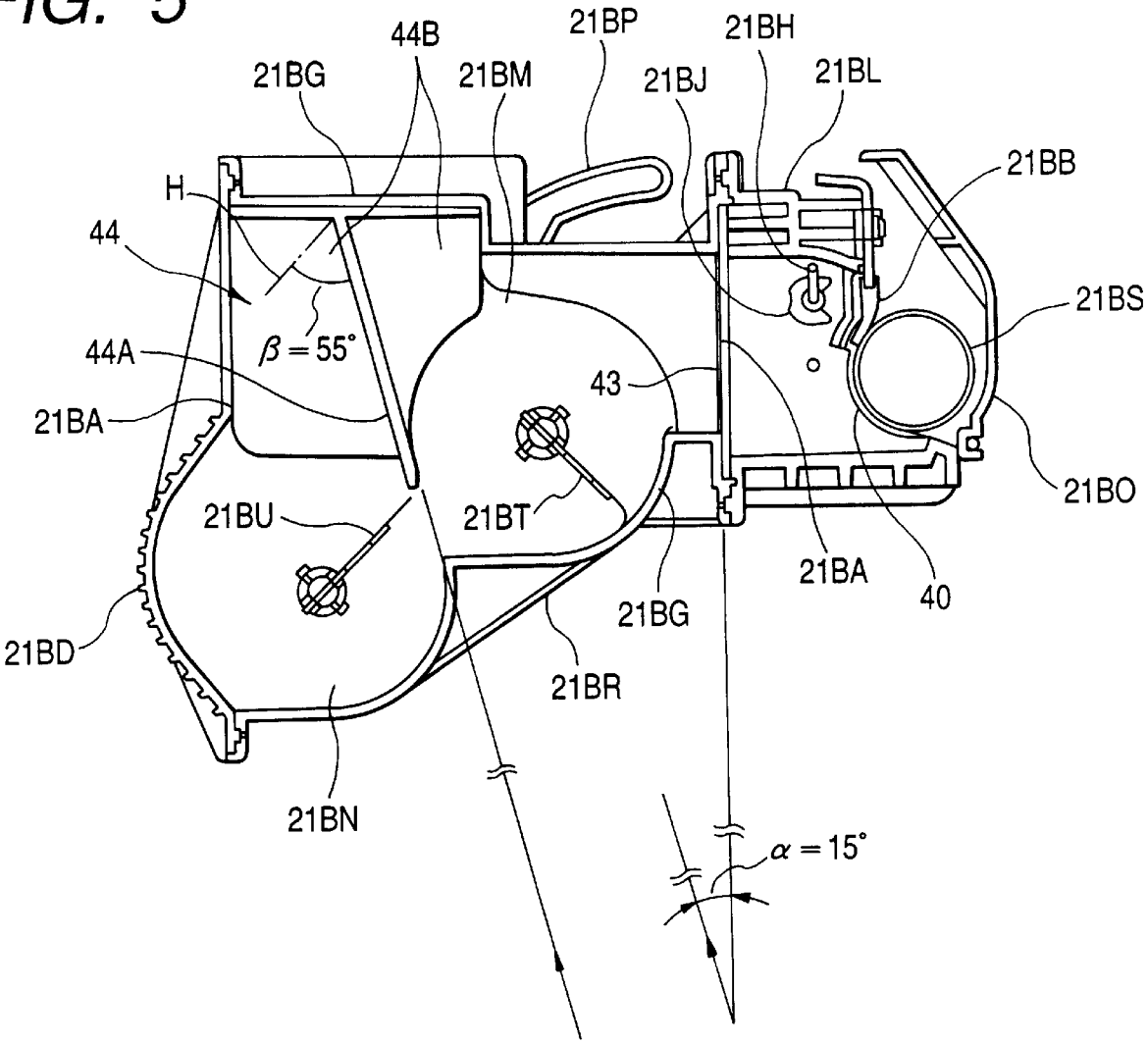
FIG. 5 is a main sectional view of the black developing unit of the embodiment.
Figure 16:
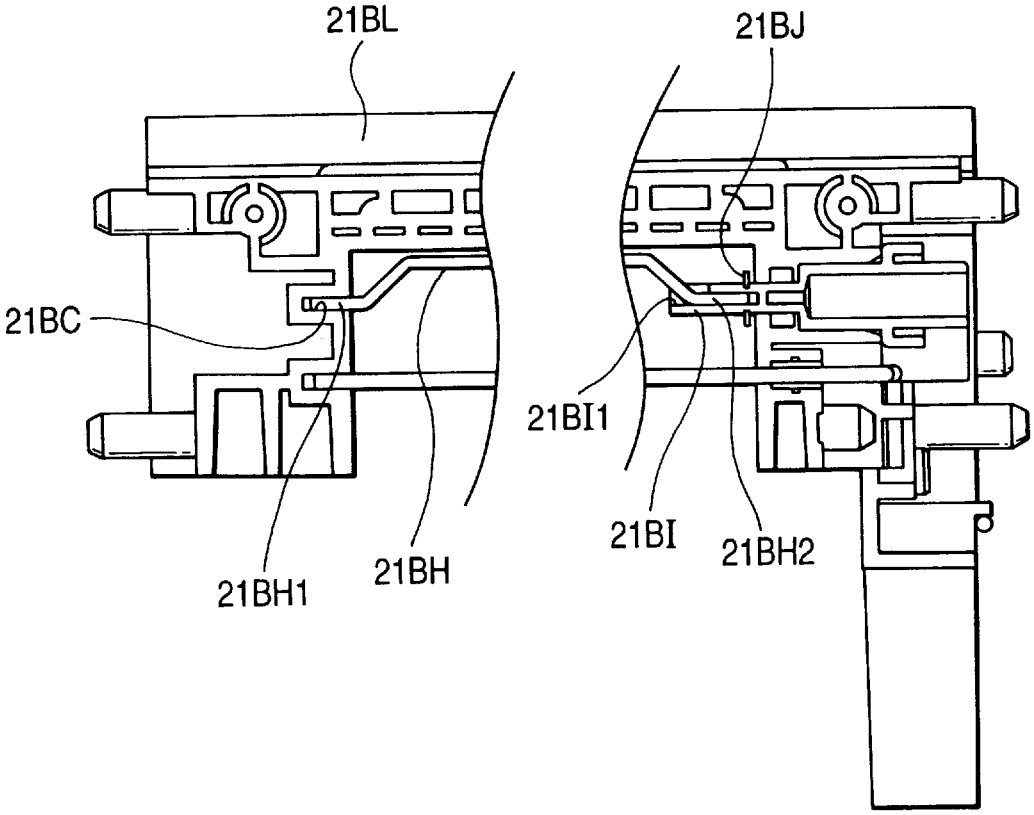
FIG. 16 is a sectional view of a developing portion frame in the black developing unit of the embodiment.

Moreover, in a developing portion 21BV, as shown in FIGS. 2, 3 and 5, there are arranged an agitating member (developer agitating member) 21BH and a rotating member 21BI. For the agitating member 21BH of the embodiment, as shown in FIG. 16, one end portion 21BH1 is supported in a hole 21BC of the developing portion frame 21BL, a nd the other end portion 21BH2 is supported in a hole 21BI1 of the rotating member 21BI. Additionally, the agitating member 21BH is fixed immobile relative to the rotating member 21BI in an axial direction.

Figure 18A:
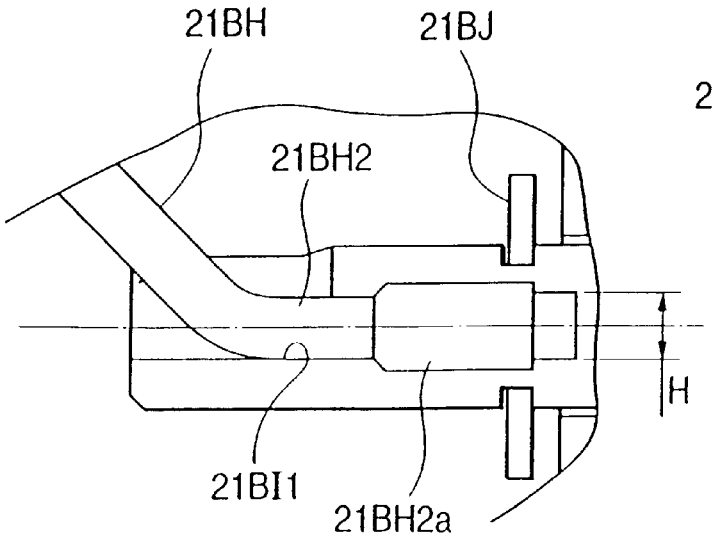
FIGS. 18A and 18B are enlarged sectional views showing the assembled state of the agitating member in the black developing unit of the embodiment.
Figure 18B:
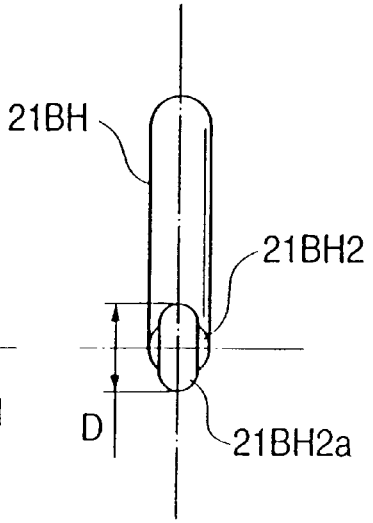

Specifically, as shown in FIGS. 18A and 18B, a portion 21BH2*a* of the other end portion 21BH2 of the agitating member 21BH is pressed to be thick, and the thick portion 21BH2*a* is inserted with pressure into the hole 21BI1 of the rotating member 21BI. In the embodiment, a dimensional relation between a height dimension D of the thick portion 21BH2*a* of the agitating member 21BH and a diameter H of the hole 21BI1 of the rotating member 21BI satisfies D−H≧0.1 mm.

By the above-described dimensional relation, a pull-off strength of the agitating member 21BH relative to the rotating member 21BI can be set to 500 gf.

Figure 17:
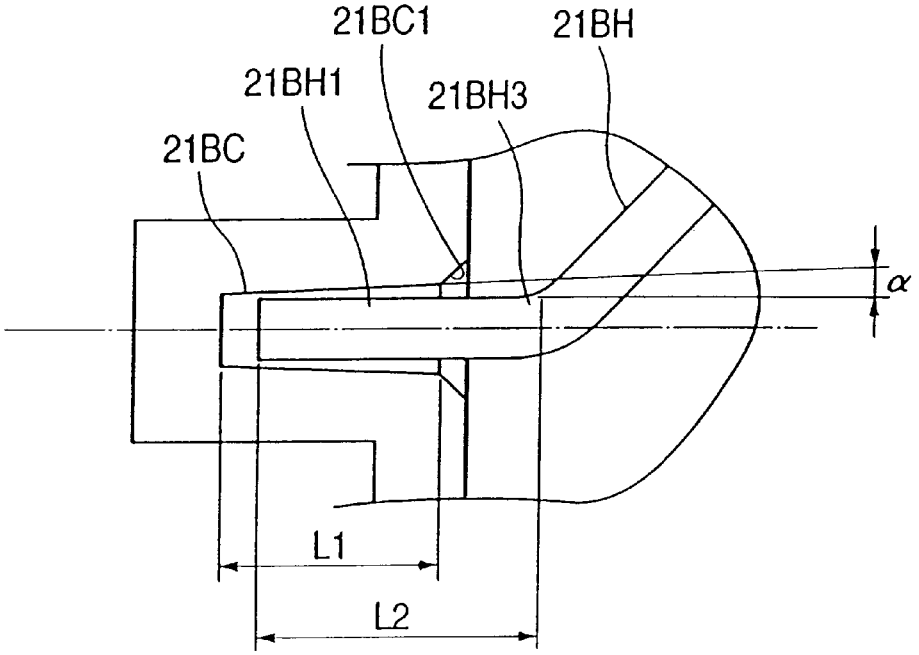
FIG. 17 is an enlarged sectional view showing an assembled state of an agitating member in the black developing unit of the embodiment.

On the other hand, the hole 21BC of the developing portion frame 21BL has a tapered shape as shown in FIG. 17, and surface sliding of one end portion 21BH1 of the agitating member 21BH is prevented. Specifically, the hole has a taper angle of $\alpha=2°$ or more relative to a peripheral surface of one end portion 21BH1 of the agitating member 21BH.

Moreover, in the embodiment, a relation between a depth L1 of the hole 21BC of the developing portion frame 21BL and a length L2 of a straight portion of one end portion 21BH1 of the agitating member 21BH satisfies L2>L1. The dimensional relation prevents a bending root 21BH3 of one end portion 21BH1 of the agitating member 21BH from interfering with a hole inlet of the developing portion frame 21BL in the axial direction.

Moreover, the inlet of the hole 21BC of the developing portion frame 21BL is provided with a chamfered portion 21BC1 to positively escape from the bending root 21BH3 of the agitating member 21BH, so that the interference with the bending root 21BH3 of the agitating member 21BH is prevented from occurring.

Additionally, to prevent the agitating member 21BH of the embodiment from falling from the developing portion frame 21BL after assembling, a stopper 21BJ as a stopping member is attached inside the rotating member 21BI.

As described above, in the agitating member support structure according to the embodiment, since the agitating member 21BH is fixed to be immobile relative to the rotating member 21BI in the axial direction, reciprocating movement of the agitating member 21BH in the axial direction can be suppressed. Thereby, the black toner fails to be positively pushed into the hole 21BC of the developing portion frame 21BL.

Moreover, since the hole 21BC of the developing portion frame 21BL is provided with the taper angle of 2° or more relative to the peripheral surface of one end portion 21BH1 of the agitating member 21BH, with the rotating operation of the agitating member 21BH, the black toner can be discharged from the hole 21BC. Additionally, since a circumferential surface of one end portion 21BH1 of the agitating member 21BH is not placed in surface contact with the hole 21BC, the adhesion of the black toner to an inner surface of the hole 21BC can be reduced.

Furthermore, since the dimensional relation between the depth L1 of the hole 21BC of the developing portion frame 21BL and the length L2 of the straight portion of one end portion 21BH1 of the agitating member 21BH satisfies L2>L1, the interference of the bending root 21BH3 of the agitating member 21BH with the inlet of the hole 21BC of the developing portion frame 21BL in the axial direction can be avoided. Situations such as the adhering of the black toner to the inlet of the hole 21BC of the developing portion frame 21BL can be prevented.

The above-described agitating member support structure can preferably be applied also to the yellow developing unit 20Y, the magenta developing unit 20M, and the cyan developing unit 20C.

Additionally, in the embodiment, to support one end portion 21BH1 of the agitating member 21BH, the hole 21BC is formed in the developing portion frame 21BL, but instead of the hole 21BC, a groove may be formed in the developing portion frame 21BL so that one end portion 21BH1 of the agitating member 21BH is supported.

[Toner Collecting Measure of Developing Portion]

Figure 6:
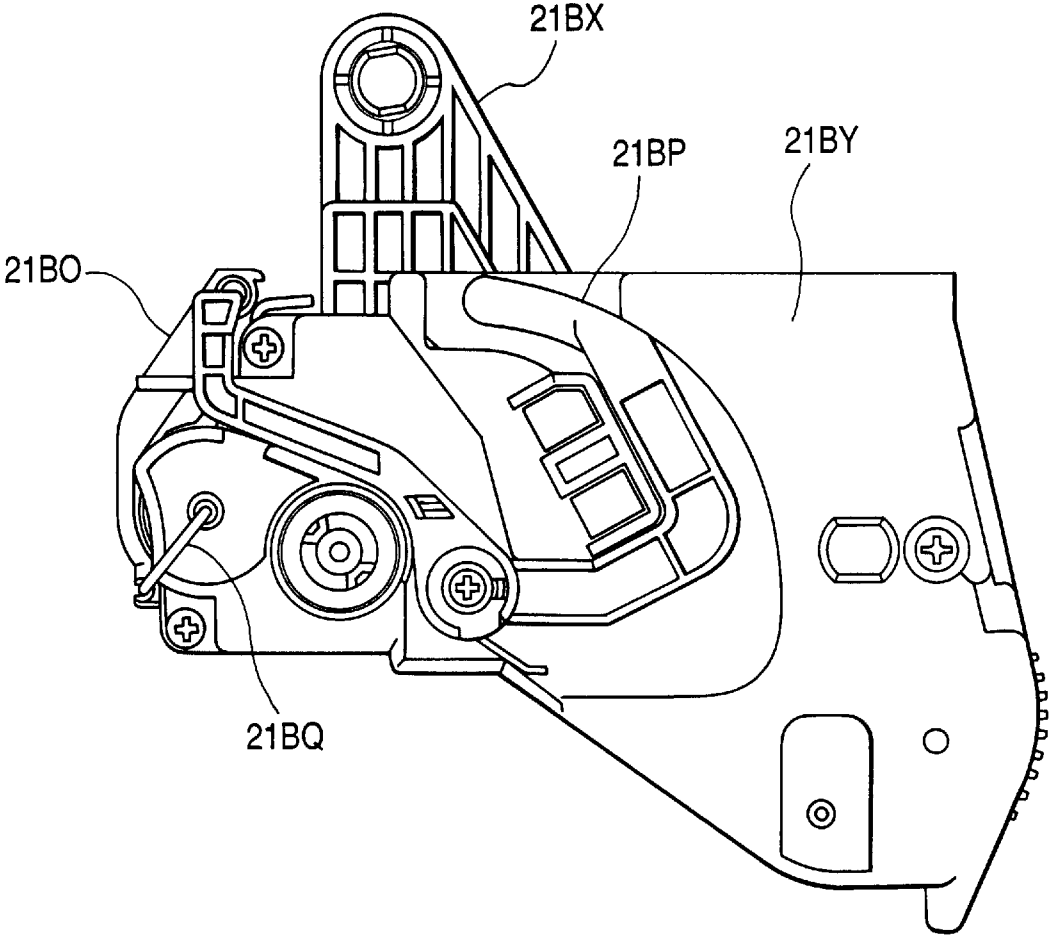
FIG. 6 is a side view of the black developing unit of the embodiment.
Figure 26:
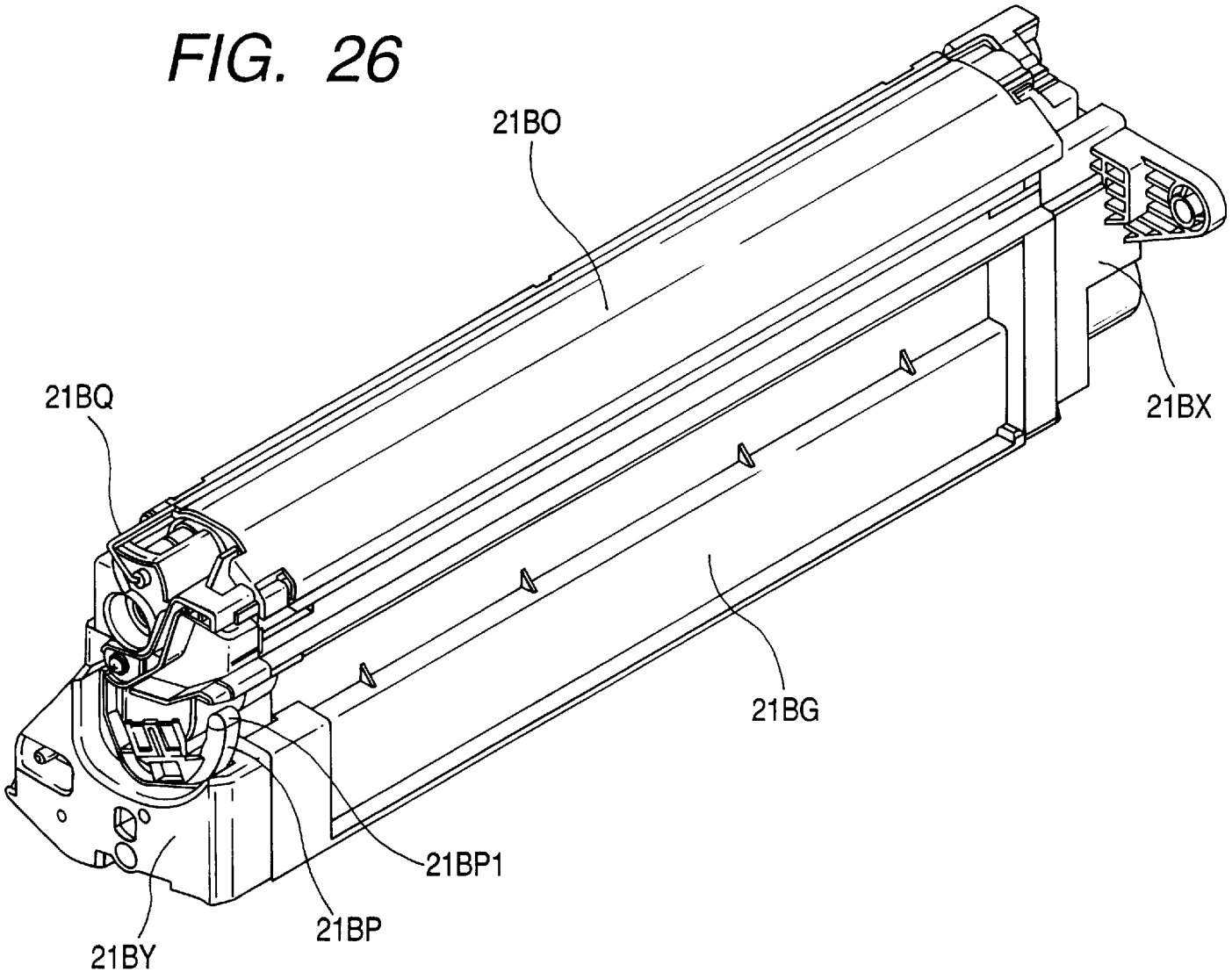
FIG. 26 is an appearance perspective view of the black developing unit of the embodiment.

Moreover, in the developing portion 21BV, as shown in FIGS. 2, 3 and 5, besides the agitating member 21BH, there are arranged the developing roller 21BS, the applying blade 21BB, an openable/closable shutter (protecting member) 21BO for protecting the developing roller 21BS, and the like. As shown in FIGS. 4, 6 and 26, the shutter 21BO is openably/closably supported by the developing portion frame 21BL via a shutter shaft 21BQ. When the black developing unit 21B is attached to the printer main body 100, the shutter is opened to expose the developing roller 21BS. When the black developing unit 21B is removed from the printer main body 100, the shutter is closed to protect the developing roller 21BS.

Additionally, in the embodiment, as shown in FIG. 3, a magnet sheet 42 as developer collecting means is disposed within 15 mm from the surface of the developing roller 21BS. For example, the sheet can be bonded and attached to a part of the developing portion frame 21BL, a part of the shutter 21BO, and a part of the applying blade 21BB.

An overall length of the magnetic sheet 42 is longer than an applied area (coating length) of the black toner applied on the developing roller 21BS. Moreover, the magnetic sheet 42 is disposed in parallel with an axial line of the developing roller 21BS.

Since the magnetic sheet 42 is disposed in this manner, the toner floating from the developing roller 21BS (toner floating around the developing roller 21BS) can positively be collected (caught) using an adsorption action by a magnetic force of the magnetic sheet 42. Therefore, contamination of the housing of the black developing unit 21B by the black toner, or the contamination of an outer surface of the drum unit 13 disposed in the vicinity of the black developing unit 21B can be prevented.

Since the magnetic sheet 42 as the developer collecting means is disposed in the developing portion 21BV in this manner, the black toner can be prevented from adhering to areas other than the developing portion 21BV.

[Measure to reduce Toner Pressure to Unsealable Seal Member by Falling (1)]

Figure 7:
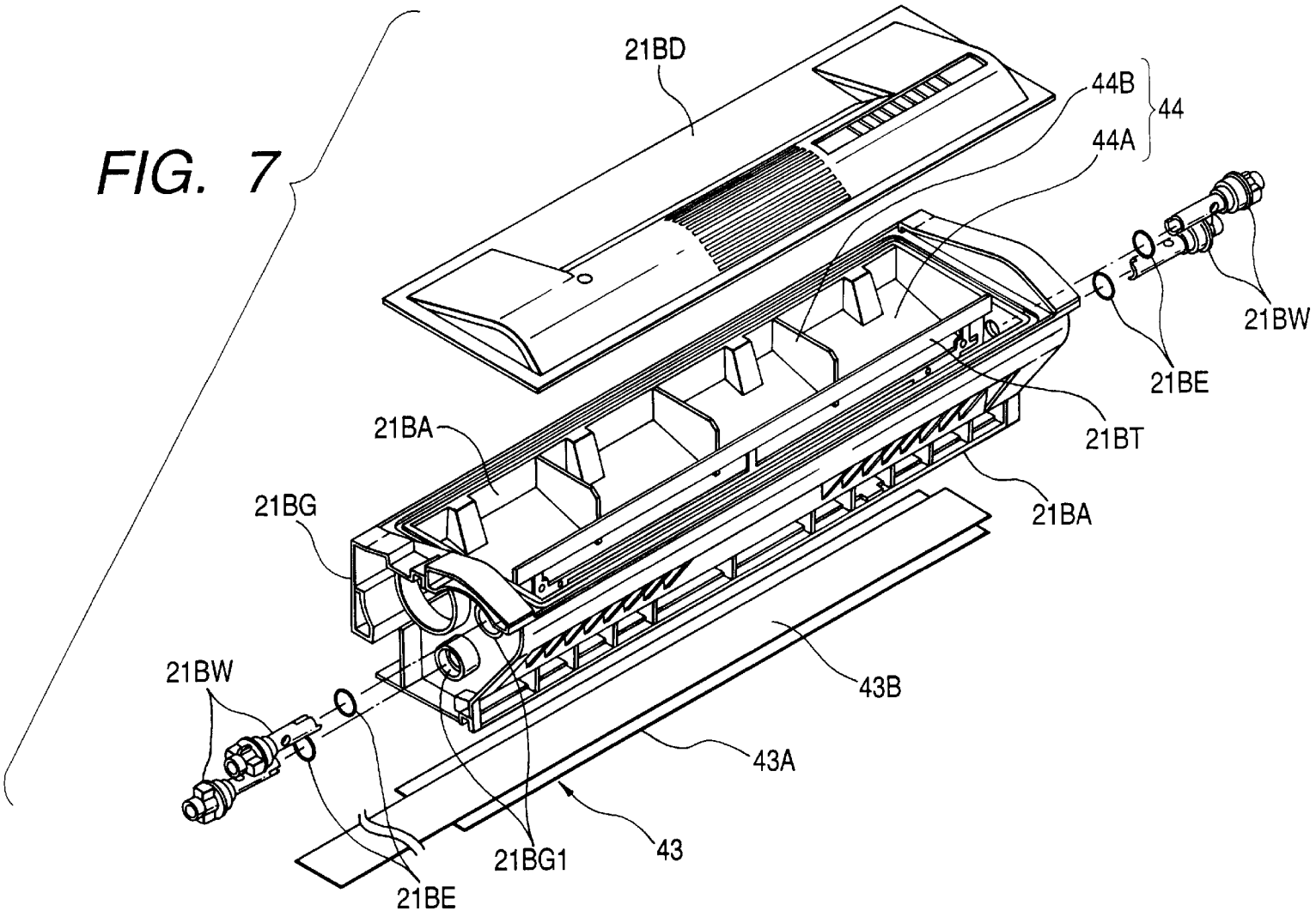
FIG. 7 is an exploded perspective view of a toner containing portion in the black developing unit of the embodiment.

In the toner containing portion 21BG, as shown in FIG. 7, upper and lower openings 21BA are formed, the upper opening 21BA is sealed with a bonded lid 21BD, and the lower opening 21BA is sealed with a bonded unsealable seal member 43.

A direction in which the black developing unit 21B is detached from the printer main body 100 is the same as a longitudinal direction of the black developing unit 21B (axial line direction of the developing roller 21BS).

Right above the lower opening 21BA, there is provided a partitioning member 44 which partitions an inner portion of the toner containing portion 21BG into a plurality of containing chambers in the longitudinal direction of the black developing unit 21B. The partitioning member 44 is constituted of a first partition wall 44A extending in the removal direction of the black developing unit 21B from the printer main body 100, and a plurality of second partition walls 44B extending vertical to the removal direction of the black developing unit 21B from the printer main body 100.

The first partition wall 44A of the partitioning member 44 is formed in such a manner that its wall surface is larger than an opening area of the lower opening 21BA (refer to FIG. 5).

Moreover, as shown in FIG. 5, the first partition wall 44 is disposed in such a manner that its wall surface has an angle $\alpha$ of 30° or less (an inclination angle of about 15° in the embodiment) relative to a bonded surface of the unsealable seal member 43 and has an angle $\beta$ of 40° or more (inclination angle of about 55° in the embodiment) relative to a horizontal plane H of the printer main body 100. Since the surface by which the seal member is supported has an angle $\alpha$ of 30° or less with the partition wall 44A, toner can be prevented from moving toward the seal member from the toner containing portion by the dropping of a new developing unit and by other causes. Since the developing unit is attached to the printer main body in such a manner that the partition wall 44A has an angle of 40° or more with the horizontal plane H, the toner fails to remain on the partition wall 44A, and can slide off along the partition wall 44A by gravity.

Since the first partition wall 44A is formed and disposed in the toner containing portion 21BG as described above, the black toner tries to move to the side of the unsealable seal member 43 by impact or vibration onto the black developing unit 21B during material flow, but collides against the first partition wall 44A. Therefore, the movement of the black toner toward the unsealable seal member 43 can be stopped by the first partition wall 44A.

Therefore, a powder pressure to the unsealable seal member 43 by the black toner can be reduced, and the unsealable seal member 43 can preferably be prevented from being broken by the powder pressure of the black toner.

Moreover, since in the toner containing portion 21BG, a plurality of second partition walls 44B of the partitioning member 44 are arranged vertical to the removal direction of the black developing unit 21B from the printer main body 100, the black toner can be distributed to the toner containing chambers between the second partition walls 44B, and deviation of the black toner in the toner containing portion 21BG can be reduced.

[Measure to reduce Toner Pressure to Unsealable Seal Member by Falling (2)]

Moreover, inside the toner containing portion 21BG, the first agitating portion 21BM and the second agitating portion 21BN are arranged, and the first feeding member 21BT and the second feeding member 21BU are rotatably supported by the agitating portions 21BM and 21BN, respectively.

In the embodiment, an uttermost end portion (uttermost tip end portion) of a rotation radius direction of the second feeding member 21BU is stopped to come close to and opposed to a tip end portion of the first partition wall 44A of the partitioning member 44 (refer to FIG. 5).

Furthermore, the first feeding member 21BT and the second feeding member 21BU have a phase difference of about 90° (as a result of experiments, 90°±15°, that is, the range of 75° to 105° is preferable) in rotation angle therebetween. Specifically, the first feeding member 21BT is stopped in a position rotated by about 90° to an upstream side relative to the second feeding member 21BU.

In a plant, stop positions of the first feeding member 21BT and the second feeding member 21BU are adjusted as described above before delivery.

As described above, since the second feeding member 21BU is stopped in such a manner that its uttermost end portion is opposed to the tip end portion of the first partition wall 44A, and the second feeding member 21BU is stopped in a rotation phase so as to deviate from the first feeding member 21BT by about 90° on the upstream side, the space around the tip end portion of the partition wall 44A is blocked with the second feeding member 21BU. Additionally, in the toner containing portion 21BG, the first partition wall 44A, the second feeding member 21BU and the first feeding member 21BT form a substantially snaking and winding space. Therefore, the black toner tries to move toward the unsealable seal member 43 by the impact or vibration onto the black developing unit 21B during the material flow, but collides against the first partition wall 44A, the second feeding member 21BU, or the first feeding member 21BT. Therefore, the movement of the black toner toward the unsealable seal member 43 can be hindered by the first partition wall 44A, the second feeding member 21BU, and the first feeding member 21BT.

Drive shafts 21BW of the first feeding member 21BT and the second feeding member 21BU are, as shown in FIG. 7, inserted into holes 21BG1 in a side surface of the toner containing portion 21BG together with oil seals 21BE. The first and second feeding members 21BT and 21BU are driven and rotated by the drive shafts 21BW.

[Constitution of Unsealable Seal Member]

Figure 8:
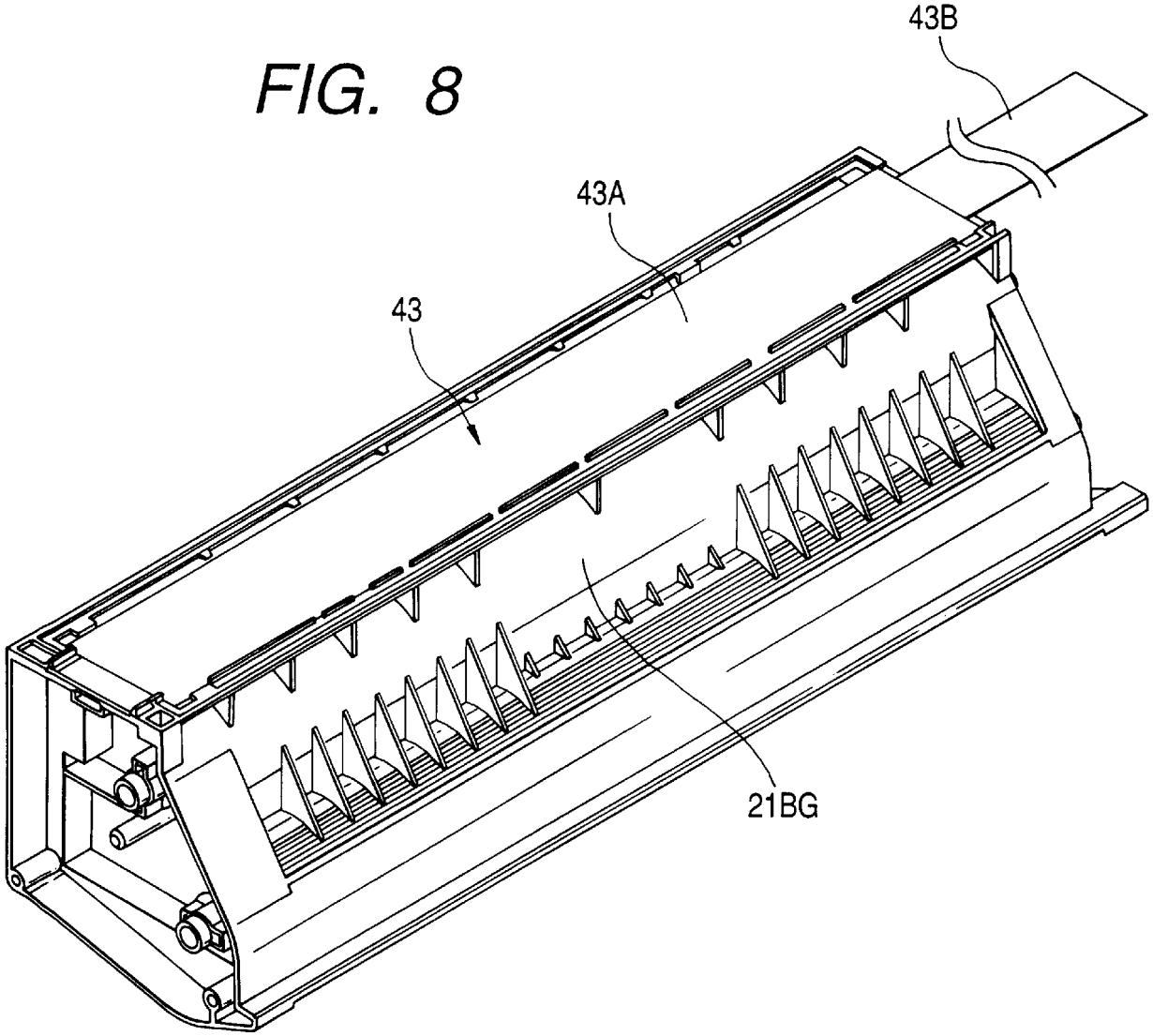
FIG. 8 is a perspective view of the toner containing portion in the black developing unit of the embodiment.
Figure 9:
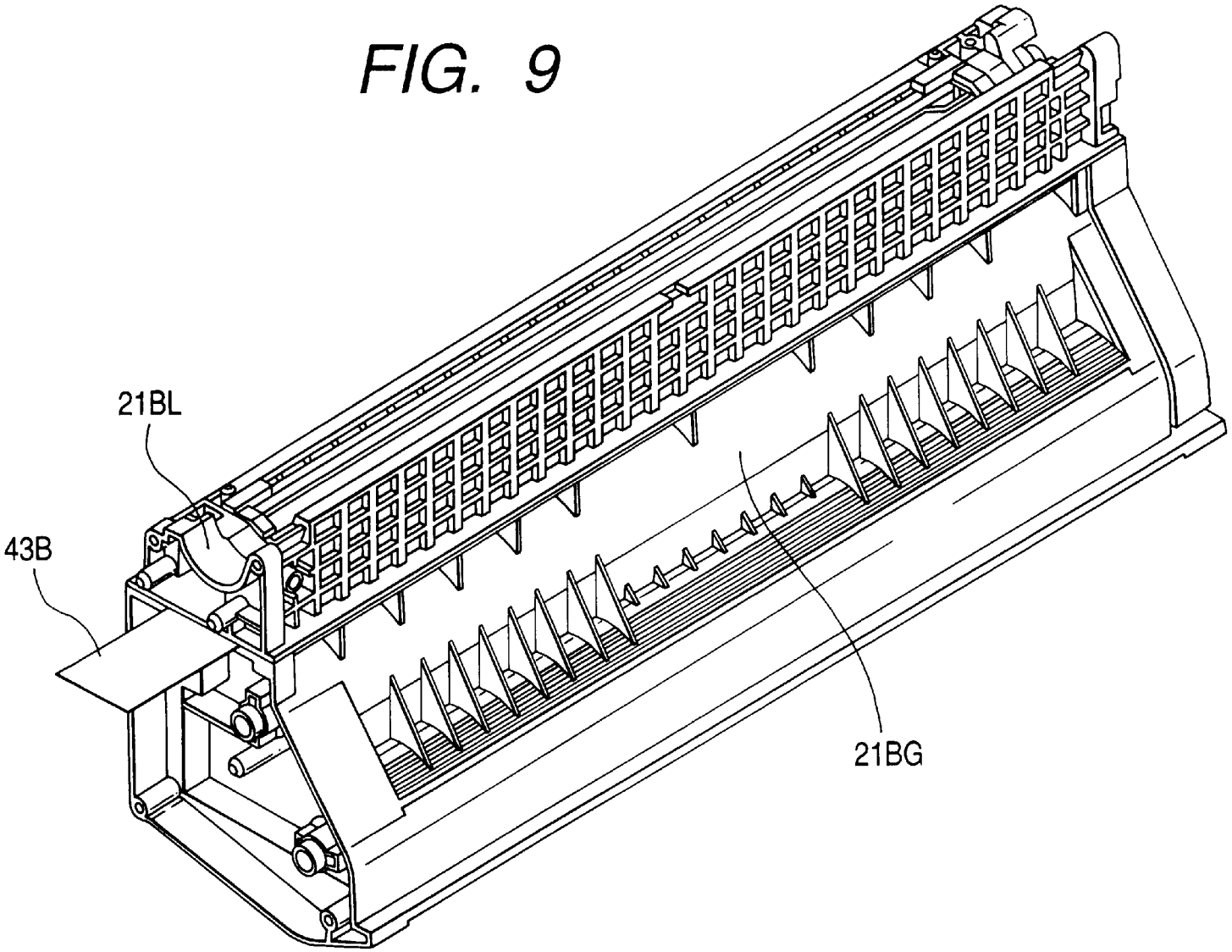
FIG. 9 is a perspective view of a part of the black developing unit of the embodiment.

For the unsealable seal member 43, as shown in FIGS. 7 and 8, a film 43A as a first sheet member for covering (sealing) the lower opening 21BA of the toner containing portion 21BG in a sealed state, and a tape 43B which is a flexible member as a second sheet member are thermally and integrally welded, to constitute a tearing seal member. In the film 43A, a uniaxial oriented film material or a sheet material which can be torn in one direction is used. For example, uniaxial oriented polyethylene, uniaxial oriented polypropylene, uniaxial oriented and foamed polypropylene, and the like are used.

Moreover, the tape 43B needs to have a sufficient strength to tear the film 43A, and a tensile strength of the tape is preferably about three times as large as that of the film 43A. As a material of the tape, for example, biaxial oriented polypropylene, polystyrene, biaxial oriented nylon, and other various film or sheet materials are used.

Figure 10:
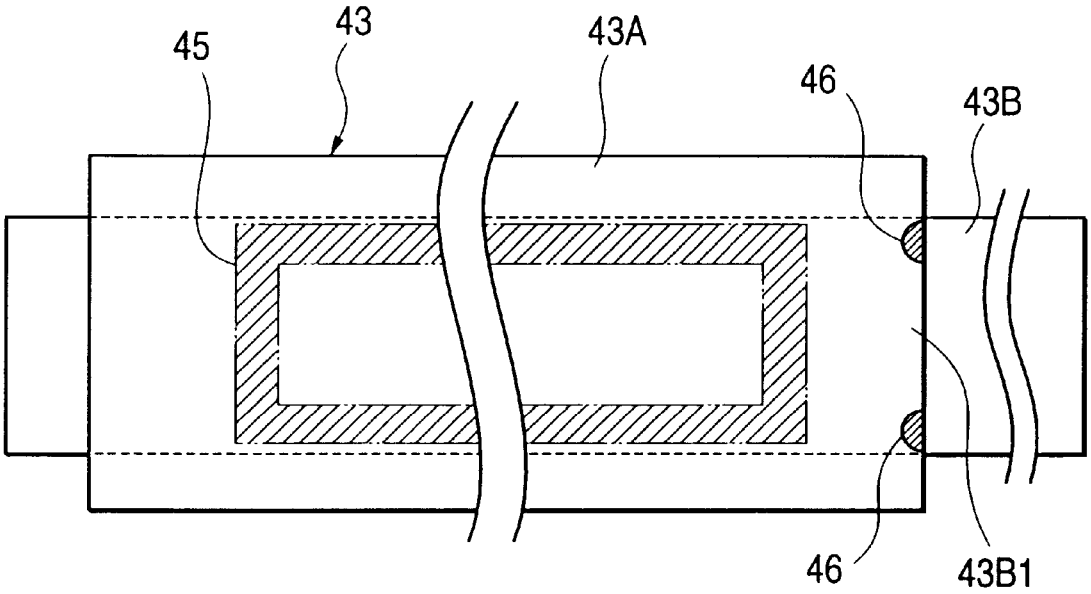
FIG. 10 is an explanatory view of an unsealable seal member of the embodiment.

As shown in FIG. 10, the film 43A and the tape 43B are bonded by a rectangular joined portion (first joined portion) 45 whose four sides are continuous along the lower opening 21BA of the toner containing portion 21BG, and a free end of the tape 43B is folded back toward the film 43A. When the folded-back free end of the tape 43B is pulled, the film 43A is torn in a constant direction while a width of the tape 43B is kept.

Figure 11:
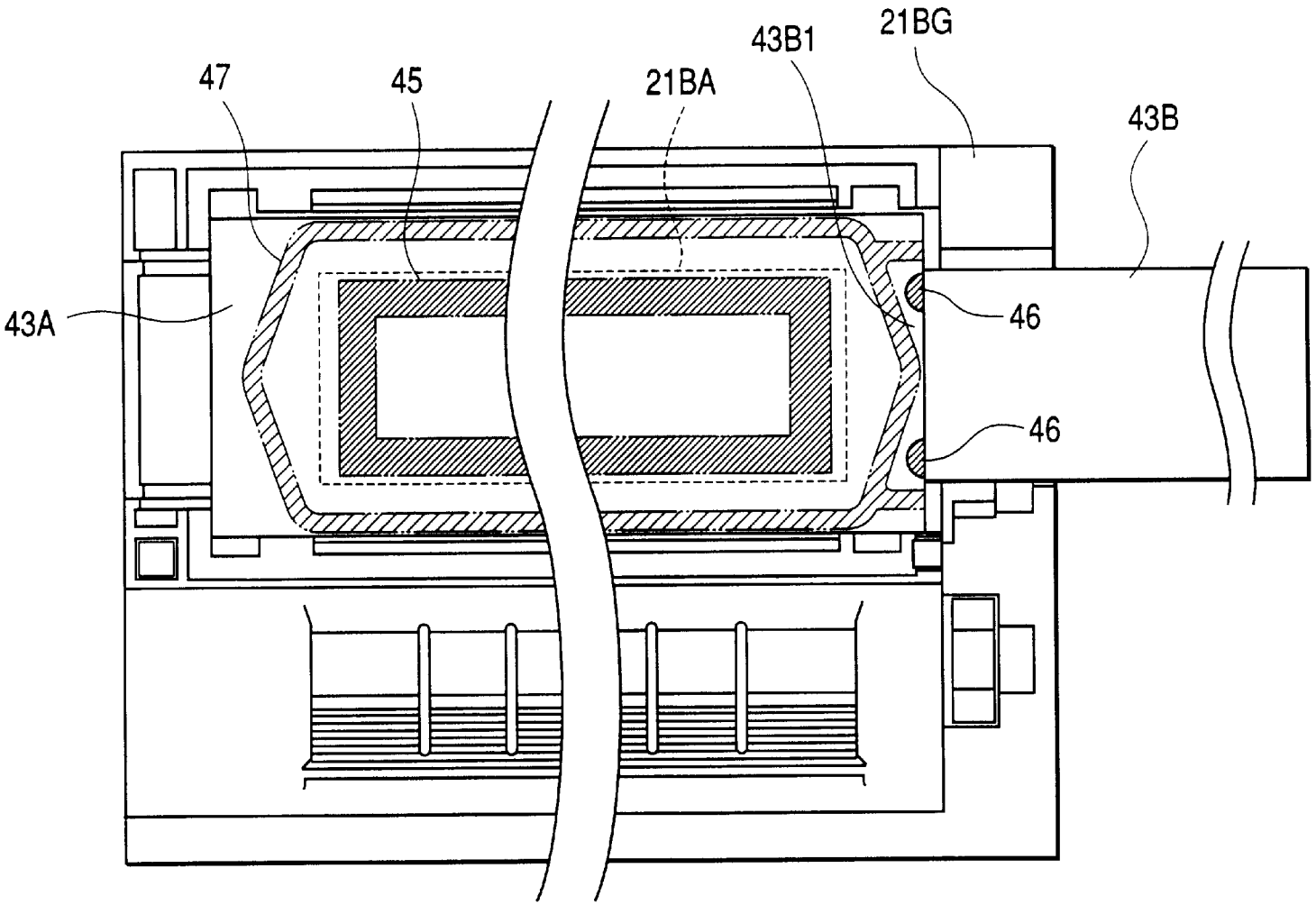
FIG. 11 is a front view of the toner containing portion provided with the unsealable seal member shown in FIG. 10.
Figure 24:
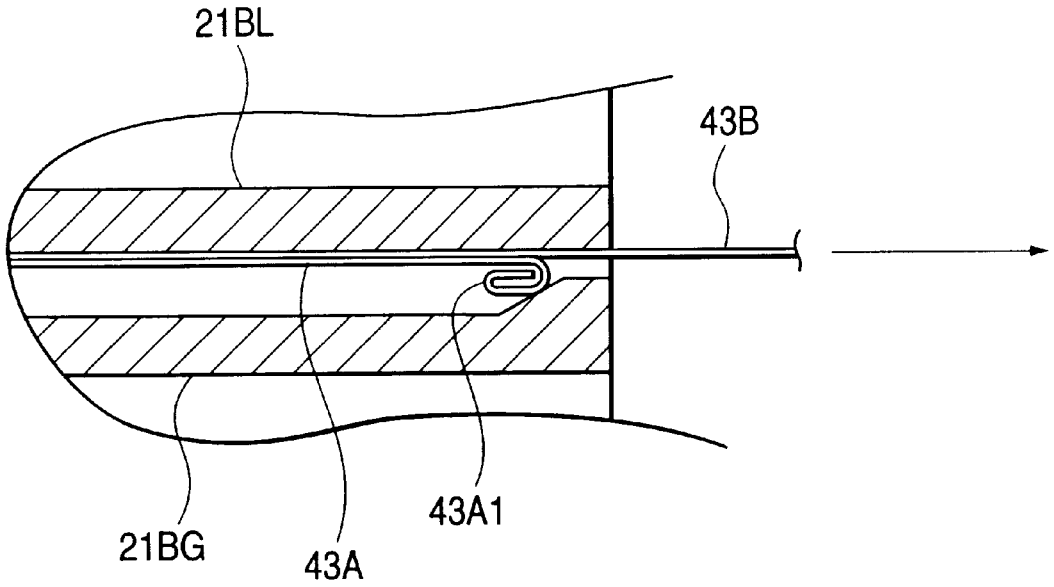
FIG. 24 is an explanatory view showing unsealing of a conventional unsealable seal member.
Figure 25:
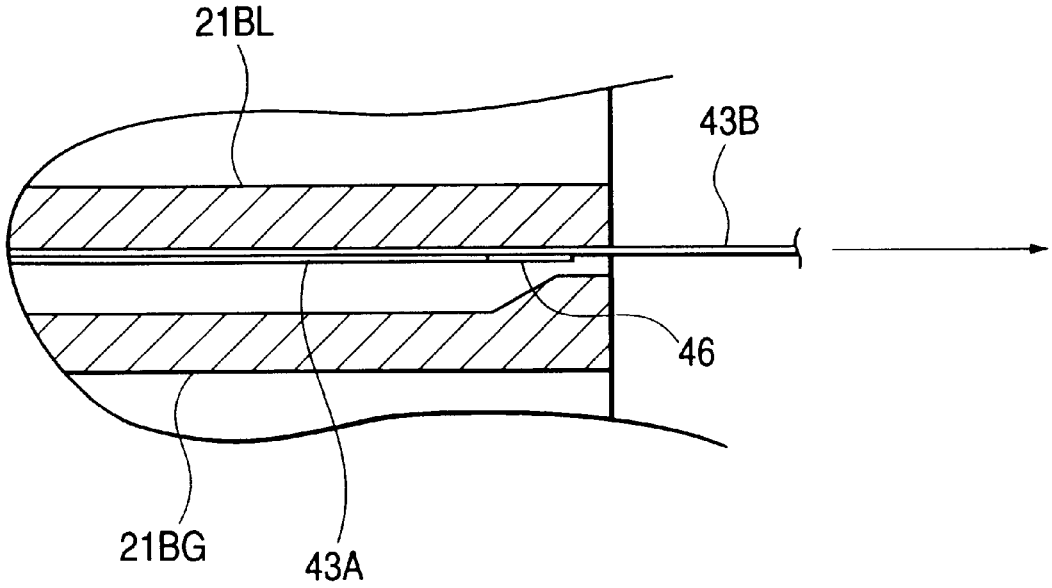
FIG. 25 is an explanatory view showing unsealing of an unsealable seal member of the embodiment.

In the embodiment, as shown in FIGS. 10, 11 and 25, in the film 43A and the tape 43B, there are discontinuously provided joined portions (second joined portions) 46 which are bonded in spotted manner in the vicinity of a folded-back portion 43B1, besides the rectangular joined portion 45 constituted of the four sides. When the tape 43B is torn, the second joined portions 46 can prevent a unjoined blank portion 43A1 generated in the vicinity of the folded-back portion 43B1 of the film 43A shown in FIG. 24 from being double-folded or triple-folded.

Therefore, the tape 43B can smoothly be pulled off without being caught halfway, and the lower opening 21BA of the toner containing portion 21BG can stably be unsealed.

Additionally, in FIG. 11, numeral 47 denotes a bonding area in which the film 43A is bonded to the toner containing portion 21BG.

Furthermore, in comparison of tensile elongation amounts of the film 43A and the tape 43B, the film 43A shows larger stretching properties than the tape 43B. For example, when the black developing unit 21B is dropped, the black toner is locally present in an unbalanced state in the container, and the unsealable seal member 43 is expanded by the powder pressure. The more the expanded amount is, the more the breaking of the film 43A can be suppressed.

Figure 12:
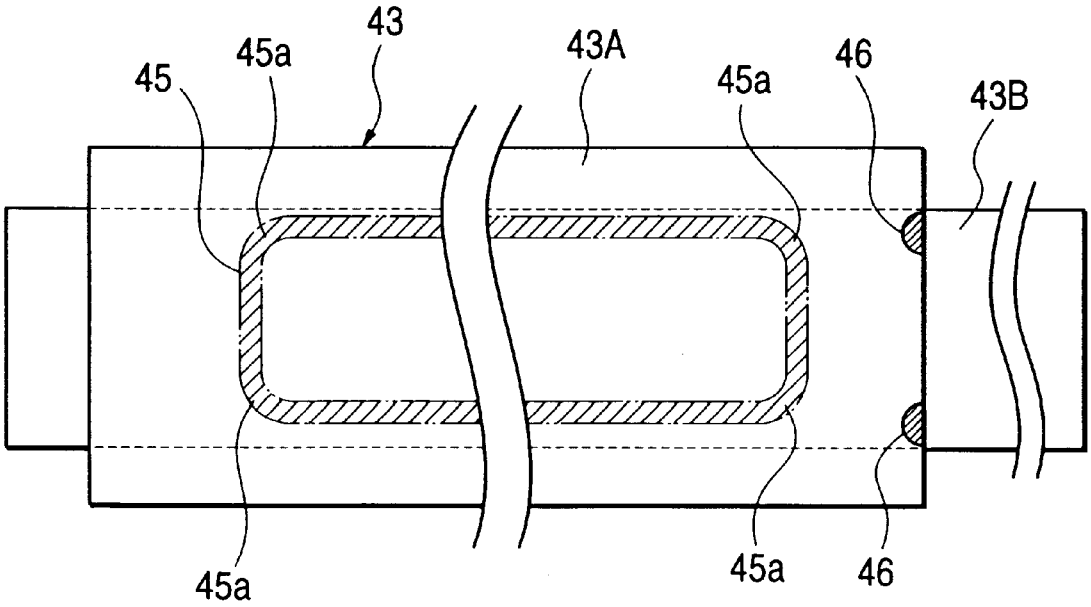
FIG. 12 is an explanatory view of another unsealable seal member of the embodiment.
Figure 13:
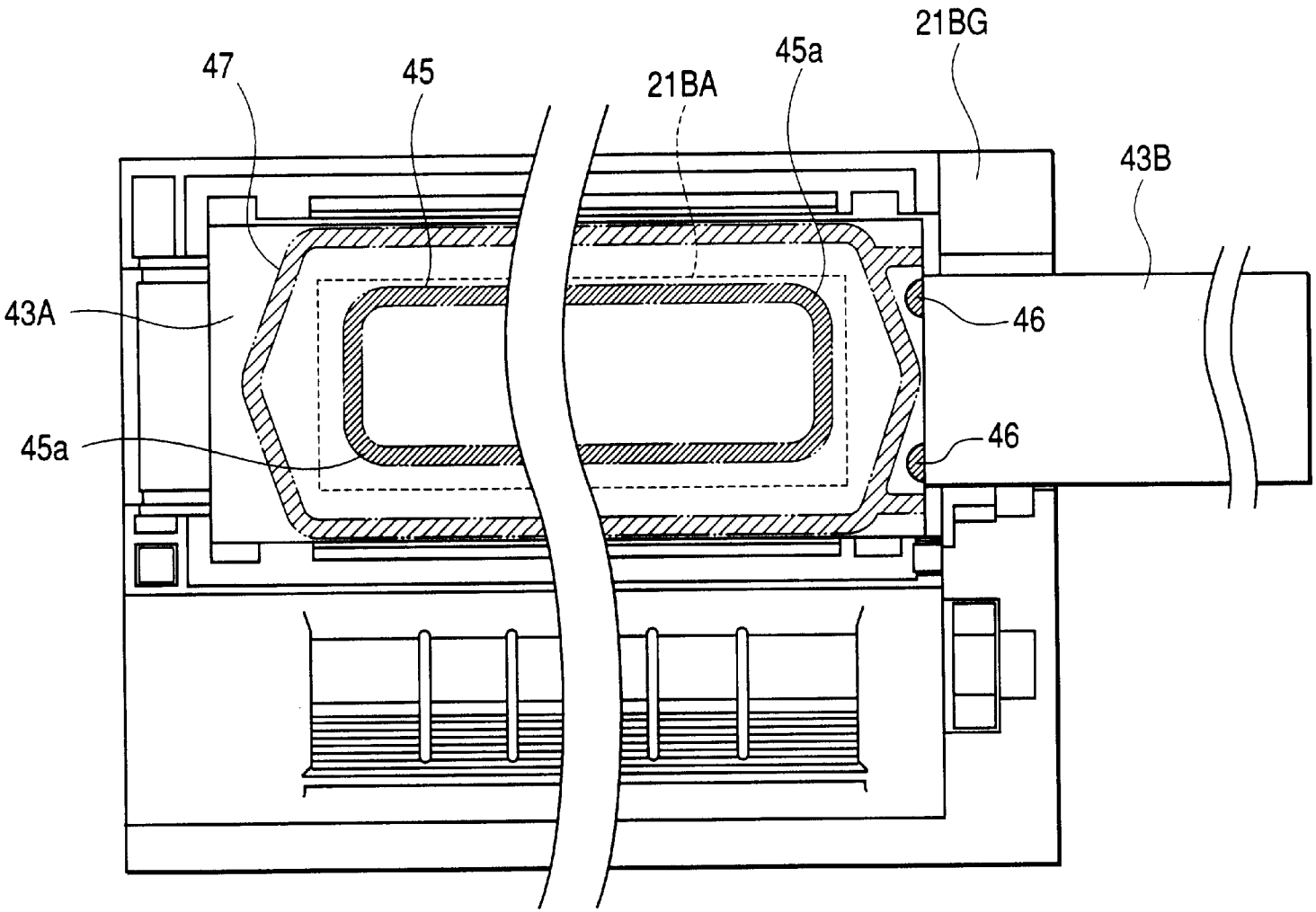
FIG. 13 is a front view of the toner containing portion provided with the unsealable seal member shown in FIG. 12.

In the embodiment, as shown in FIGS. 12 and 13, a corner portion in which adjacent two sides of the rectangular bonded portion 45 constituted of the four sides intersect each other is formed into a circular arc-shaped joined portion 45*a*. For the circular arc-shaped joined portion 45*a*, even when the powder pressure of the black toner is exerted on the film 43A by the impact or vibration during the material flow, the circular arc-shaped joined portion 45*a* is easily expanded in a direction in which the toner powder pressure acts. The elongation of a short direction (direction in which two short sides of the joined portion 45 extend, that is, a width direction of the unsealable seal member 43) of the unsealable seal member 43 can be increased. This can prevent the unsealable seal member 43 from being broken at the corner portion of the joined portion 45 by the impact or vibration during the material flow.

Figure 14:
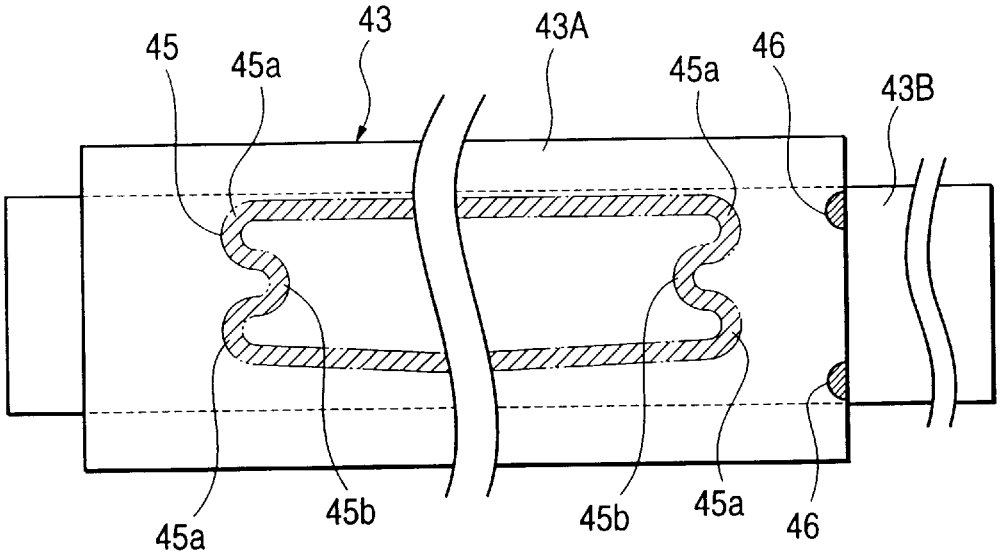
FIG. 14 is an explanatory view of further unsealable seal member of the embodiment.
Figure 15:
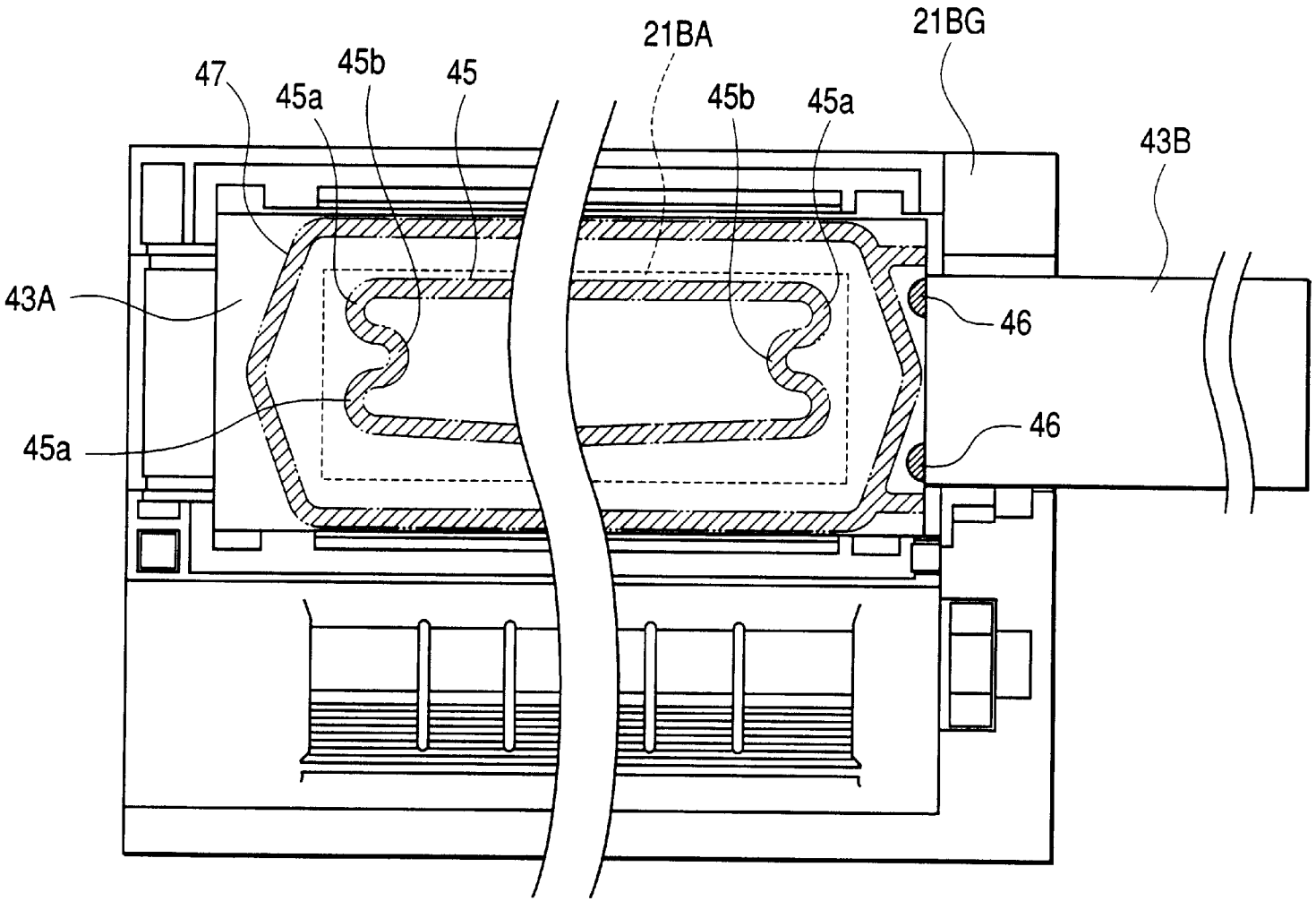
FIG. 15 is a front view of the toner containing portion provided with the unsealable seal member shown in FIG. 14.

Moreover, in the embodiment, as shown in FIGS. 14 and 15, circular arc-shaped bent portions 45*b* are formed in the two short sides of the rectangular joined portion 45 constituted of the four sides. For the circular arc-shaped bent portions 45*b*, even when the powder pressure of the black toner is exerted on the film 43A by the impact or vibration during the material flow, the circular arc-shaped bent portions 45*b* in the two sides are easily expanded in the direction in which the black toner powder pressure acts. The elongation of the short direction (direction in which two short sides of the joined portion 45 extend, that is, the width direction of the unsealable seal member 43) of the unsealable seal member 43 can be increased. This can prevent the unsealable seal member 43 from being broken at two short sides of the joined portion 45 by the impact or vibration during the material flow.

By employing the above-described constitution, the black developing unit 21B can be provided with the large-capacity toner containing portion 21BG which can contain a large amount of black toner.

Incidentally, in the embodiment, one bent portion 45*b* is formed in each of the two short sides of the joined portion 45, but the bent portions 45*b* may be formed in a plurality of places.

The above-described joining structure of the film 43A and the tape 43B of the unsealable seal member 43 can preferably be applied also to the yellow developing unit 20Y, the magenta developing unit 20M, and the cyan developing unit 20C.

[Constitution of Toner Seal Member (Developer Seal Member)]

A constitution of a toner seal member 40 as a developer seal member according to the embodiment will be described.

As shown in FIGS. 19A and 19B, the toner seal member 40 is divided in a first layer 40A and a second layer 40C. The first layer 40A is formed of a fiber having a low friction coefficient and a wear resistance, and a fluoroplastic fiber, a synthetic fiber of polyester, acrylate, nylon, and the like, a chemical fiber of rayon, and the like, and a fiber blending of these fibers are preferable.

In general, the fluoroplastic fiber is preferably used, and for example, polytetrafluoroethylene (PTFE), tetrafluoroethylene-hexafluoropropylene copolymer (FPT), tetrafluoroethylene-perfluoroalkylvinylether copolymer( PFA), tetrafluoroethylene copolymer (ETFE), and the like can be used.

Figure 20:
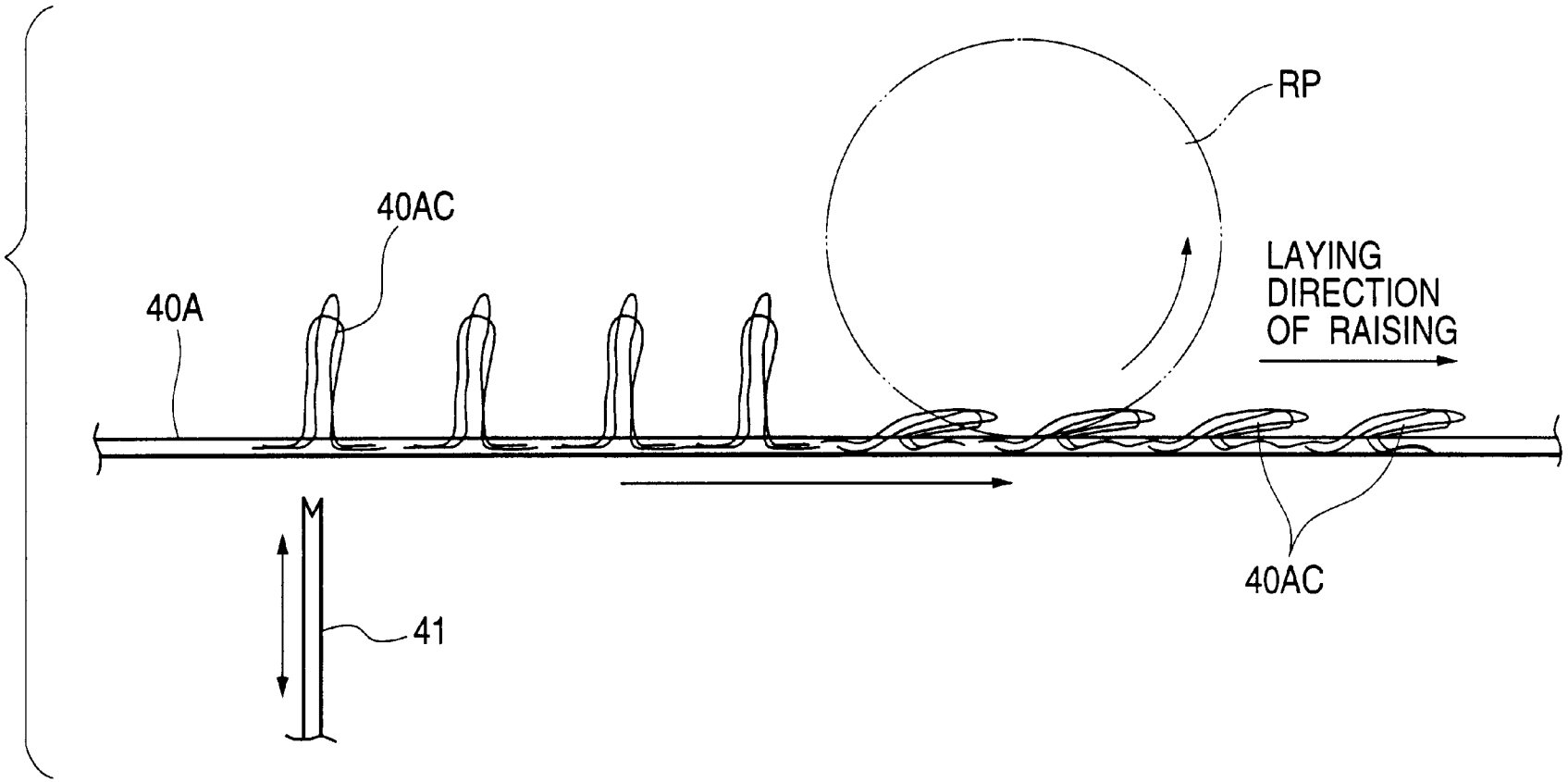
FIG. 20 is an explanatory view of processing of the toner seal member of the embodiment.

In the embodiment, the felted fiber blending of PTFE is used in the first layer 40A. As shown in FIG. 20, for the felt, a fork needle 41 is used to protrude the fiber to a height of 0.5 to 5 mm from a felt surface, so that a looped raising 40AC is formed.

Subsequently, in a raising retention treatment, the looped raising 40AC is laid using a roll press RP or the like in a constant direction, that is, in the same direction as the axial line direction of the developing roller 21BS, and a fabric thickness is uniformed. Furthermore, the laid raising 40AC of the developer seal member 40 is directed toward the inside of the developing roller 21BS.

Subsequently, the first layer 40A and polyurethane foam of the second layer 40C as a cushion material (e.g., Poron manufactured by INOAC Ltd.) are bonded with a double-coated tape 40B having no base material (e.g., No. 5619 manufactured by Nitto Electric Industrial Co., Ltd., F-69PC manufactured by Sumitomo 3M Ltd., and the like).

Furthermore, a both faces tape 40D having no base material in the same manner as described above is bonded to an outer side of the second layer 40C (an opposite side of the first layer 40A).

As shown in FIG. 21, the toner seal member 40 is fixed to the developing portion frame 21BL outside the lower opening 21BA of the toner containing portion 21BG in a bent state along the circumferential surface (outer peripheral surface) of the developing roller 21BS by the both faces tape 40D. The black toner is supplied to the developing roller 21BS from the opening 21BA. In this case, the raising 40AC of the felt surface of the first layer 40A adheres to a part of the circumferential surface (outer peripheral surface) of the developing roller 21BS (a part outside a black toner applied area (outside a black toner held area)).

Since the toner seal member 40 is fixed to the developing portion frame 21BL in this manner, the looped raising 40AC of the felt surface of the first layer 40A catches/collects the black toner on the outer peripheral surface of the developing roller 21BS, so that the black toner is prevented from flowing to the outside.

Moreover, since the laid looped raising 40AC of the first layer 40A is directed toward the inside of the longitudinal direction of the developing roller 21BS, resistance in black toner flow-out direction can be increased, and the black toner can further be prevented from flowing to the outside.

Moreover, the first layer 40A and the second layer 40C are bonded using the double-coated tape 40B having no base material. Therefore, when the toner seal member 40 is bent along the circumferential surface of the developing roller 21BS and fixed to the developing portion frame 21BL, the felt surface of the first layer 40A can be prevented from being wrinkled.

Furthermore, since the both faces tape 40D having no base material is bonded to the outer side of the second layer 40C, the toner seal member 40 can correctly be fixed to the developing portion frame 21BL so as to be bent along the circumferential surface of the developing roller 21BS.

In the embodiment, the toner seal members 40 are disposed on both end portions of the developing roller 21BS of the black developing unit 21B, but needless to say, the members may be disposed on both end portions of longitudinal direction of the developing roller 20YS, 20MS, or 20CS of the yellow developing unit 20Y, the magenta developing unit 20M, or the cyan developing unit 20C, or on both end portions of longitudinal direction of the image bearing member 15 as the process cartridge. By disposing the toner seal members 40 constituted as described above on both end portions of the longitudinal direction of the developing roller 20YS, 20MS, 20CS, or the image bearing member 15, the same effect as the above-described effect of the toner seal member 40 can be obtained.

[Shutter Constitution]

Additionally, the shutter 21BO for protecting the developing roller 21BS as described above is rotatably held in the black developing unit 21B (refer to FIGS. 2, 5 and 26). As shown in FIG. 26, a shutter opening/closing member 21BP is rotatably attached to a holder 21BY disposed on a rear side of the black developing unit 21B, and pushed in one direction by a spring (not shown).

Moreover, the shutter shaft 21BQ is disposed over a holder 21BX disposed on a front side of the black developing unit 21B, disposed on the same axial line as the axial line of the developing roller 21BS, and rotatably supported by an attaching member (not shown).

In this state, when a rotating moment is applied to the other end portion (arm tip end) 21BP1 of the shutter opening/closing member 21BP in a direction at a right angle with a mother line of the image bearing member 15, the shutter opening/closing member 21BP rotates, and the shutter 21BO smoothly rotates/moves.

To realize the rotation of the shutter opening/closing member 21BP, in the embodiment, an opening/closing guide member 51 is disposed in a swinging guide portion 50 disposed in the printer main body 100 (refer to FIG. 2). The opening/closing guide member 51 is fixed to the swinging guide portion 50, and has a wall surface formed of a moderate slope.

When the user inserts the black developing unit 21B into the swinging guide portion 50 to some degree, the arm tip end 21BP1 of the shutter opening/closing member 21BP abuts against the opening/closing guide member 51. Furthermore, when the black developing unit 21B continues to be inserted, the arm tip end 21BP1 of the shutter opening/closing member 21BP moves along the moderate slope formed on the opening/closing guide member 51.

The shutter 21BO as the protecting member of the embodiment is molded of a permanent charge preventing resin whose surface resistivity is in the range of $10^5$ to $10^{13}$ Ω/sq. Since the shutter 21BO is molded of the permanent charge preventing resin, dirt, fluff, and the like can be prevented from electrostatically adhering to the shutter 21BO.

Examples of hydrophilic polymer for use in the permanent charge preventing resin include polyethylene glycol methacrylate copolymer, poly(ethylene oxide/propylene oxide) copolymer, polyethylene glycol polyamide, polyethylene glycol polyester amide, poly(epichlorhydrin/ethylene oxide) copolymer, and the like.

(Other Embodiments)

In the above embodiment, the color toner image forming apparatus as the electrophotographic image forming apparatus has been illustrated, but the present invention does not have to be limited to this apparatus, and the same constitution can be used, for example, in a monochromatic electrophotographic image forming apparatus, an electrophotographic copying machine, an electrophotographic facsimile machine, an electrophotographic word processor and other electrophotographic image forming apparatuses.

Moreover, the electrophotographic photosensitive member is not limited to the photosensitive drum (image bearing member), and for example, the followings are included. First as the photosensitive member, a photoconductive member is used, and examples of the photoconductive member include amorphous silicon, amorphous selenium, zinc oxide, titanium oxide, organic photoconductive material (OPC), and the like. As a mounted shape of the photosensitive member, for example, a drum shape or a belt shape is used. For example, in the drum type photosensitive member, the photoconductive material is deposited or applied onto a cylinder of an aluminum alloy or the like.

Moreover, as the developing method, a known two-component magnetic brush developing method, cascade developing method, touchdown developing method, cloud developing method, and other various developing methods can be used.

Furthermore, as the charging means constitution, in the above-described embodiment, the so-called contact charging method is used, but it is natural that another method may be used which comprises applying a metal shield, for example, of aluminum or the like to a three-way periphery of a tungsten wire heretofore used; moving a positive or negative ion generated by applying a high voltage to the tungsten wire to the surface of the photosensitive drum; and uniformly charging the drum surface.

Additionally, as the charging means, besides the above-described roller, a blade (charging blade), a pad, a block, a rod, a wire, and the like may be used.

Moreover, in the method of cleaning the toner remaining on the photosensitive drum, the cleaning means may be constituted using a blade, a fur brush, a magnetic brush, and the like.

Furthermore, the drum unit as the above-described process cartridge is provided, for example, with the electrophotographic photosensitive member, and at least one process means acting on the electrophotographic photosensitive member. Therefore, besides the aforementioned embodiment, examples of the process cartridge include an integral cartridge of the electrophotographic photosensitive member and charging means which is detachably attachable to the image forming apparatus main body, an integral cartridge of the electrophotographic photosensitive member and cleaning means which is detachably attachable to the image forming apparatus main body, and the like.

In the above-mentioned developing apparatus, the developer tries to move toward the unsealable seal member by the impact or vibration onto the developing unit during the material flow, but collides against the partition wall surface, so that the movement of the developer toward the unsealable seal member can be blocked by the partition wall. Therefore, the powder pressure of the developer to the unsealable seal member can be reduced, and the unsealable seal member can be prevented from being broken by the powder pressure of the developer. Moreover, during the operation of the developing apparatus, the developer fails to be retained by the partition wall.

Moreover, the developing unit tries to move toward the unsealable seal member by the impact or vibration onto the developing unit during the material flow, but collides against the partition wall, the second feeding member, or the first feeding member, so that the movement of the developer toward the unsealable seal member can be blocked by the partition wall, the second feeding member, and the first feeding member. Therefore, the powder pressure of the developer to the unsealable seal member can be reduced, and the unsealable seal member can be prevented from being broken by the powder pressure of the developer.

What is claimed is:

1. A developing apparatus installed in a unit which is detachably attachable to a main body of an image forming apparatus, comprising:

a developer bearing member for bearing and carrying a developer to a developing position; and a developer containing portion for containing the developer, said developer containing portion including an opening portion for supplying the developer to said developer bearing member, a sheet member for unsealably sealing the opening portion, and a partition wall for partitioning a space of said developer containing portion into a first space and a second space more remote from said developer bearing member than the first space;

wherein an area of the partition wall is larger than an open area of said opening portion, the partition wall has an angle of 30° or less with respect to a surface on which the sheet member is supported, and has an angle of 40° or more with respect to a horizontal plane when said developing apparatus is attached to the main body of said image forming apparatus.

2. The developing apparatus according to claim 1, wherein the partition wall extends in a direction in which said developing apparatus is attached to and detached from the main body of said image forming apparatus.

3. The developing apparatus according to claim 1, wherein said developer containing portion includes a plurality of partition walls extending in a direction intersecting with the partition wall.

4. The developing apparatus according to claim 1, wherein said developer containing portion includes a plurality of partition walls extending in a direction vertical to the partition wall.

5. The developing apparatus according to claim 3 or 4, wherein the plurality of partition walls partition the space of said developer containing portion into a plurality of spaces together with the partition wall for partitioning the space into the first space and the second space.

6. The developing apparatus according to claim 1, wherein said developer containing portion includes a first carrying member, disposed in the first space, for carrying the developer toward the opening portion, and a second carrying member, disposed in the second space, for carrying the developer toward the first space.

7. The developing apparatus according to claim 6, wherein the second carrying member is rotatable, and a tip end portion of the second carrying member in a rotation radius direction thereof is stopped in such a manner that the tip end portion comes close to a tip end portion of the partition wall, before the sheet member is unsealed.

8. The developing apparatus according to claim 7, wherein the first carrying member can rotate in the same rotating direction as that of the second carrying member, and the first carrying member is stopped so as to deviate from a stop position of the second carrying member on an upstream side of a rotating direction by an angle of 75° to 105°, before the sheet member is unsealed.

9. The developing apparatus according to claim 6, 7, or 8, wherein a portion in which the first space and the second space are interconnected to each other is disposed below the partition wall when said developing apparatus is attached to the main body of said image forming apparatus.

10. A developing apparatus installed in a unit which is detachably attachable to a main body of an image forming apparatus, comprising:

a developer bearing member for bearing and carrying a developer to a developing position; and a developer containing portion for containing the developer, said developer containing portion including an opening portion for supplying the developer to said developer bearing member, a sheet member for unsealably sealing the opening portion, a partition wall for partitioning a space of said developer containing portion into a first space and a second space more remote from said developer bearing member than the first space, a first carrying member, disposed in the first space, for carrying the developer to the opening portion, and a second carrying member, disposed in the second space, for carrying the developer toward the first space, the first carrying member and the second carrying member being rotatable in the same rotating direction;

wherein the second carrying member being stopped in such a manner that a tip end portion of the second carrying member in a rotation radius direction thereof comes close to a tip end portion of the partition wall, before the sheet member is unsealed, and the first carrying member being stopped so that a rotation phase may deviate from a stop position of the second carrying member on an upstream side of the rotating direction by an angle of 75° to 105°, before the sheet member is unsealed.

11. The developing apparatus according to claim 10, wherein the partition wall extends in a direction in which said developing apparatus is attached to or detached from the main body of said image forming apparatus.

12. The developing apparatus according to claim 10, wherein said developer containing portion includes a plurality of partition walls extending in a direction intersecting with the partition wall.

13. The developing apparatus according to claim 10, wherein said developer containing portion includes a plurality of partition walls extending in a direction vertical to the partition wall.

14. The developing apparatus according to claim 12 or 13, wherein the plurality of partition walls partition the space of said developer containing portion into a plurality of spaces together with the partition wall for partitioning the space into the first space and the second space.

15. The developing apparatus according to claim 10, wherein a portion in which the first space and the second space are interconnected to each other is disposed below the partition wall when said developing apparatus is attached to the main body of said image forming apparatus.

16. The developing apparatus according to claim 10, wherein the first carrying member is stopped by contacting with a bottom surface of said developer containing portion before the sheet member is unsealed.

* * * * *

UNITED STATES PATENT AND TRADEMARK OFFICE

CERTIFICATE OF CORRECTION

PATENT NO. : 6,064,844

DATED : May 16, 2000

INVENTOR(S) : HIRONOBU ISOBE, ET AL.

It is certified that error appears in the above-identified patent and that said Letters Patent is hereby corrected as shown below:

COLUMN 10
Line 51, "a nd" should read --and--.

COLUMN 13
Line 43, "ther-" should read --there--; and
Line 44, "ebetween." should read --between.--.

COLUMN 15
Line 51, "copolymer(" should read --copolymer--; and
Line 52, ""PFA)," should read --(PFA)--.

COLUMN 16
Line 19, "area))." should read --area).--.

COLUMN 17
Line 49, "followings" should read --following--.

UNITED STATES PATENT AND TRADEMARK OFFICE

CERTIFICATE OF CORRECTION

PATENT NO. : 6,064,844

DATED : May 16, 2000

INVENTOR(S) : HIRONOBU ISOBE, ET AL.

It is certified that error appears in the above-identified patent and that said Letters Patent is hereby corrected as shown below:

COLUMN 18

Line 62, "space;" should read --space,--.

COLUMN 20

Line 12, "direction;" should read --direction,--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*